United States Patent [19]

Merrill et al.

[11] 4,322,487

[45] Mar. 30, 1982

[54] COMPOSITE ELECTRICALLY PHOTOSENSITIVE PARTICLES FOR ELECTROPHORETIC MIGRATION IMAGING PROCESS

[75] Inventors: Stewart H. Merrill; Frederick A. Stahly; Ernest W. Turnblom; Beth G. Wright; Hal E. Wright, all of Rochester, N.Y.

[73] Assignee: Eastman Kodak Company, Rochester, N.Y.

[21] Appl. No.: 64,972

[22] Filed: Aug. 8, 1979

[51] Int. Cl.[3] ..... G03G 5/06; G03G 17/04

[52] U.S. Cl. ..... 430/37; 430/41

[58] Field of Search ..... 430/32, 37, 38, 73, 430/74; 204/181

[56] References Cited

U.S. PATENT DOCUMENTS

| | | | |
|---|---|---|---|
| 3,140,175 | 7/1964 | Kaprelian | 430/138 |
| 3,265,496 | 8/1966 | Fox | 430/73 |
| 3,384,488 | 5/1968 | Tulagin et al. | 430/37 |
| 3,645,883 | 2/1972 | Luebbe et al. | 204/300 |
| 3,681,064 | 8/1972 | Yeh | 430/37 |
| 3,982,938 | 8/1976 | Honjo et al. | 430/83 |
| 4,012,376 | 3/1977 | Wright | 430/37 |
| 4,076,527 | 2/1978 | Nealy | 430/38 |

FOREIGN PATENT DOCUMENTS

| | | | |
|---|---|---|---|
| 1242262 | 8/1971 | United Kingdom | 430/37 |
| 1418292 | 12/1975 | United Kingdom | 430/37 |
| 1440553 | 6/1976 | United Kingdom | 430/107 |

OTHER PUBLICATIONS

Research Disclosure, 17241, 8/78, pp. 54–56.

*Primary Examiner*—Richard C. Schilling
*Assistant Examiner*—John L. Goodrow
*Attorney, Agent, or Firm*—Torger N. Dahl

[57] ABSTRACT

The present invention provides novel composite electrically photosensitive particles. Each of said particle comprises a colorant and a polymeric binder comprising repeating units containing one or more structures selected from the classes consisting of triarylamines; p-aminotetraarylmethanes; 4,4′-bis(p-amino)triarylmethanes; 1,1-bis(p-aminoaryl)isobutanes; 1,1-bis(p-aminoaryl)cyclohexanes; N-alkyl-N,N-diarylamines; N,N-dialkyl-N-arylamines and heterocyclic nitrogen compounds having about 4 to 10 carbon atoms.

21 Claims, 1 Drawing Figure

Figure 1:
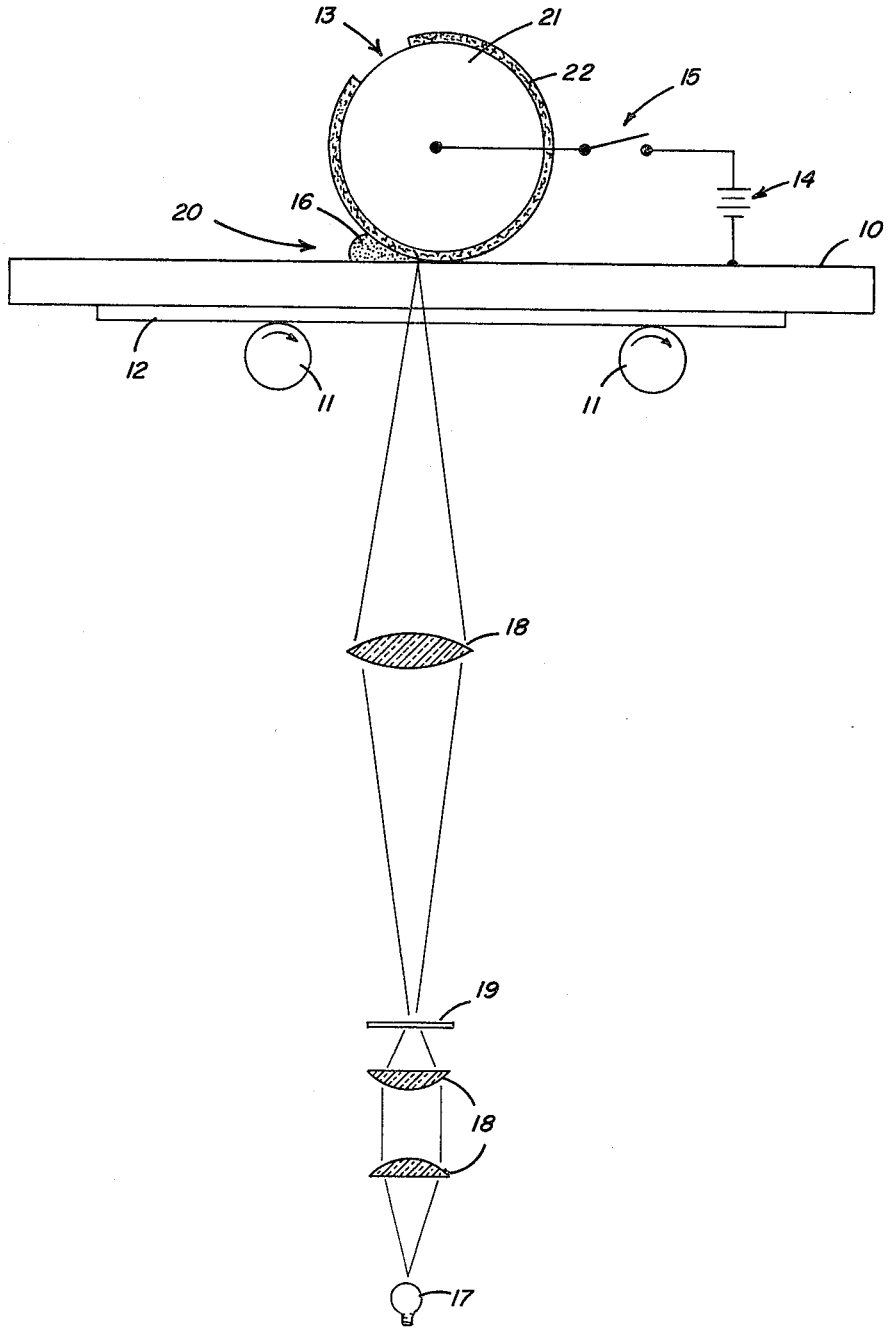

COMPOSITE ELECTRICALLY PHOTOSENSITIVE PARTICLES FOR ELECTROPHORETIC MIGRATION IMAGING PROCESS

FIELD OF THE INVENTION

This invention relates to electrophoretic migration imaging and in particular, to certain novel composite electrically photosensitive particles and their use in migration imaging.

BACKGROUND OF THE INVENTION

In the past, there has been extensive description in the patent and other technical literature of electrophoretic migration imaging processes. For example, a description of such processes may be found in U.S. Pat. Nos. 2,758,939 by Sugarman issued Aug. 14, 1956; 2,940,847, 3,100,426, 3,140,175 and 3,143,508, all by Kaprelian; 3,384,565, 3,384,488 and 3,615,558, all by Tulagin et al; 3,384,566 by Clark; and 3,383,993 by Yeh. In addition to the foregoing patent literature directed to conventional photoelectrophoretic migration imaging processes, another type of electrophoretic migration imaging process which advantageously provides for image reversal is described in Groner, U.S. Pat. No. 3,976,485 issued Aug. 24, 1976.

In general, each of the foregoing electrophoretic migration imaging processes typically employs a layer of electrically photosensitive particles, positioned between two spaced electrodes, one of which may be transparent. To achieve image formation in these processes, the electrically photosensitive particles positioned between the two spaced electrodes, as described above, are subjected to the influence of an electric field and exposed to activating radiation. The electrically photosensitive particles migrate electrophoretically and deposit imagewise on the surface of one or the other of the spaced electrodes. Thus, an image pattern is formed on the surface of these electrodes. Typically, a negative image is formed on one electrode, and a positive image is formed on the opposite electrode.

An essential component of any electrophoretic migration imaging process is the electrically photosensitive particles. To obtain an easy-to-read, visible image it is important that these electrically photosensitive particles be colored, as well as electrically photosensitive. Research efforts to find particles which possess both useful levels of electrical photosensitivity and which exhibit good colorant properties continue.

The art discloses the use of electrically photosensitive particles comprising a polymer and a pigment for use in migration imaging processes. Many of the polymers disclosed for such use, however, have a deleterious effect on the electrically photosensitive particles in that the polymers insulate the particle from the electrodes thereby inhibiting development. For example, British Pat. Nos. 1,242,262 and 1,440,553 disclose the use of polymeric photoconductors in such particles. However, this art does not teach that composite particles which include a polymeric photoconductor have any special utility in improving the results of migration imaging processes. Indeed, only a few photoconductive polymers such as polyvinylcarbazole, are disclosed in the art.

SUMMARY OF THE INVENTION

The present invention provides novel composite electrically photosensitive particles. Each of said particles comprises a colorant and a polymeric binder which contains repeating units derived from at least one compound selected from the classes consisting of triarylamines; p-aminotetraarylmethanes; 4,4'-bis(p-amino)-triarylmethanes; 1,1-bis(p-aminoaryl)isobutanes; 1,1-bis(p-aminoaryl)cyclohexanes; N-alkyl-N,N-diarylamines; N,N-dialkyl-N-arylamines and heterocyclic nitrogen compounds having about 4 to 10 carbon atoms.

As will be explained hereinafter the colorant may or may not be electrically photosensitive. This represents a particularly useful feature as it permits the use of non-electrically photosensitive colorants as some or all of the colorant components contained in the composite particles of the invention.

Regardless of whether or not an electrically photosensitive colorant is contained in the composite particles of the invention, the resultant composite particles are electrically photosensitive.

The phrase "electrically photosensitive particle" as used herein, refers to particles which, when placed between two electrodes, subjected to an applied electric field, and exposed to radiation to which said particles are sensitive, migrate to one of the two electrodes used in migration imaging processes.

In general the composite particles of the present invention exhibit greater photosensitivity in migration imaging processes than an electrically photosensitive colorant alone. Such particles also exhibit greater sensitivities than many of the composite particle combinations taught in the art.

In a preferred embodiment the present invention provides novel composite electrically photosensitive particles. Each of said particles comprises a colorant dispersed in a polymeric binder which comprises repeating units containing one or more structures selected from the group consisting of

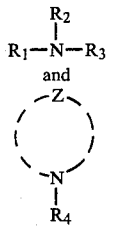

I.

and

II.

wherein:

$R_1$ represents a substituted or unsubstituted aryl;

$R_2$ and $R_3$, which are the same or different, represent carboxyalkyl, alkyl, hydroxyalkyl, styrylcarbonyl, alkenyl, benzyl, or substituted or unsubstituted aryl;

$R_4$ represents hydrogen, alkyl, vinylaryl, substituted or unsubstituted aryl, or a covalent bond to an adjacent ring carbon atom;

Z represents sufficient atoms to form a substituted or unsubstituted alkylene chain of about 4 to 10 carbon atoms or a substituted or unsubstituted heterocyclic ring selected from the group consisting of pyrazoline, pyrrole, imidazole, isoindole, 9,9'-bijulolidine, phenothiazine, julolidine, 3,3'-bipyrazoline or piperidine.

The substituents on the alkylene chain defined for Z in Formula II, are selected from the group consisting of hydrogen, oxo, carboxy, alkyl, carbonyl, alkenyl, hydroxy and substituted or unsubstituted aryl.

The substituents on aryl groups defined for $R_1$, $R_2$, $R_3$ and $R_4$ in Formulas I and II, are selected from the group consisting of styrylvinyl, alkylcarboxyalkyl, hydroxyalkyl, alkoxy, vinyl ($CH_2$=CH—), alkyl, alkoxycarbonyl, carboxyalkyl, triarylalkyl, benzoylalkenyl, carboxyalkenyl, 5-styryl-2-furanyl-alkenyl, 2-furanylalkenyl, p-(N-ethyl-N-tolylamino)-arylazo, p-alkylarylazo, carboxy, 2-quinolinylalkenyl and 6-alkyl-4-oxo-4(H)-2-pyranylalkenyl, arylalkanediyl, alkanetriyl, cycloalkanediyl, isoalkanediyl, oxoalkenediyl, diarylalkylene, alkanetetrayl, arylalkanediyl, styryl, cyano, halo, alkylcarbonyl, oxoalkyl, isoalkyl, benzyl, oximidoalkyl, semicarbazonoalkyl, aryloxoalkenyl, cycloalkyl, p-N,N-dialkylaminoarylazo and condensed aryl.

The substituents on the heterocyclic ring defined for Z in Formula II, are the same as $R_4$ above.

In a more preferred embodiment the present invention provides novel composite electrically photosensitive particles. Each particle comprises a colorant and a novel polymeric binder which comprises repeating units having one or more structures selected from the group consisting of

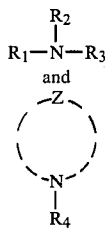

III.

and

IV.

wherein:

$R_1$ represents a substituted or unsubstituted member selected from the group consisting of phenyl and naphthyl;

$R_2$ and $R_3$, which are the same or different, represent methyl, ethyl, hydroxyethyl, carboxyethyl, benzyl, substituted or unsubstituted phenyl;

$R_4$ represents a covalent bond to an adjacent ring carbon atom or a substituted or unsubstituted phenyl;

Z represents sufficient atoms to form a substituted or unsubstituted alkylene bridge of about 4 to 10 carbon atoms or a substituted or unsubstituted heterocyclic ring selected from the group consisting of pyrrole, 9,9'-bijulolidine, phenothiazine, julolidine, and pyrazoline;

The substituents on the phenyl or naphthyl defined in Formulas III and IV above, are selected from the group consisting of methyl, ethyl, isobutyl, benzyl, carboxyethyl, cyclohexyl, vinyl, diphenylethyl, triphenylmethyl, hydroxyethyl, p-(N-ethyl-N-tolylamino)-phenylazo, 2-quinolinylethenyl, 6-methyl-4-oxo-4(H)-2-pyranyl-ethenyl, and methoxy.

The substituents on the alkylene bridge defined for Z in Formula IV, are selected from the group consisting of oxo, carboxy, alkyl, acyl, cyano and hydroxy.

The substituents on the heterocyclic ring defined for Z in Formula IV are the same as for $R_4$ in Formula IV.

In the foregoing definitions of Formulas I, II, III and IV, alkyl refers to hydrocarbons having about 1 to about 4 carbon atoms. Aryl refers to phenyl, naphthyl, and aromatic heterocyclic and carbocyclic groups having about 4 to 10 carbon atoms in the aromatic ring.

In another aspect, the present invention provides "selectively sensitized" electrophoretic migration imaging dispersions comprising an electrically insulating carrier which can be a liquid, and two or more differently colored electrically photosensitive particles and optionally a charge control agent. At least a portion of the photosensitive particles in the dispersion are composite particles according to the present invention. Because the polymeric binder of the composite particles combines with a colorant to form electrically photosensitive particles which do not significantly affect the sensitivity of other electrically photosensitive particles in the dispersion having a different color, the resultant dispersions are referred to herein as "selectively sensitized".

In yet another aspect the present invention provides an electrophoretic migration imaging process which comprises (a) subjecting a plurality of electrically photosensitive particles positioned between at least two electrodes to an applied electric field and (b) exposing said particles to an image pattern of radiation to which said particles are photosensitive, thereby obtaining image formation on at least one of said electrodes, (c) the improvement wherein at least a portion of the electrically photosensitive particles is a composite particle according to the present invention.

The composite electrically photosensitive particles of the present invention are useful in forming monocolor (i.e., monochrome) images or multicolor (i.e., polychrome) images. In accord with one preferred embodiment, selectively sensitized polychrome migration imaging dispersions are provided. In such case, by appropriately choosing the binders and colorants of the composite particles used in a selectively sensitized polychrome migration imaging dispersion containing a mixture of two or more differently colored electrically photosensitive composite particles, the sensitivity response of the electrically photosensitive composite particles of each color can be optimized to provide a balanced multicolor reproduction of an original.

FIGURE I is a schematic drawing of an apparatus for performing a migration imaging process using the composite particles of the present invention.

DETAILED EXPLANATION OF THE INVENTION

We will now proceed to describe in detail the polymeric binders and colorants which are useful in forming the composite electrically photosensitive particles of the present invention. Methods of making the particles, dispersions of such particles and methods of using such particles will also be explained and exemplified.

The polymeric binders are homopolymers or copolymers of two or more monomers. The repeating units of such polymers form the backbone of the polymer and contain the structures of formulas I–IV above. These structures are an integral portion of the polymer backbone or are pendant from the backbone. Ideally, for the present purposes, the polymer should contain at least about 20 mole percent of one or more such repeating units containing the structures described hereinbefore, although polymers containing less than about 20 mole percent may also be effective depending upon the particular polymer-colorant combination. The polymeric binders are polyesters, polycarbonates, polyacrylates, or other vinyl type polymers, polyamides, polyacetals, polyarylamines, or arylamine-aldehyde condensation resins.

Useful classes of compounds from which the repeating units of the polymeric binder may be derived include triarylamines, p-aminotetraarylmethanes, 4,4'-bis(N,N-disubstituted p-amino)triarylmethanes, 1,1-bis(N,N-disubstituted p-aminoaryl)isobutanes, 1,1-bis(N,N-disubstituted p-aminoaryl)cyclohexanes; N-alkyl-N,N-diarylamines; N,N-dialkyl-N-arylamines and heterocyclic nitrogen compounds. Representative compounds of each of these classes are set out in Table I. The compounds of Table I have been previously described as photoconductors or sensitizers in U.S. Pat. Nos. 3,180,730; 3,265,496; 3,274,000; 3,291,600; 3,526,501; 3,542,544; 3,542,547; 3,706,554; 3,767,393; 3,820,989; 3,873,311; 3,873,312 and 4,025,341.

TABLE I 4,4'-dimethyl-4''-ethyl triphenylamine
4-(di-p-tolylamino)styrene
4,4'-bis(N-ethyl-N-2-hydroxyethylamino)-2,2'-dimethyltriphenylmethane
tri-p-tolylamine
4-ethyltriphenylamine
4-(N-phenothiazinyl)styrene
4-(dibenzylamino)styrene
2,3,4,5-tetraphenylpyrrole
2,3,4,5-tetra-p-anisylpyrrole
2,3,5-triphenylpyrrole
p-diphenylaminocinnamide
4-formyltriphenylamine semicarbazone
4-cyanotriphenylamine
7-diethylamino-4-methylcoumarin
4-N,N-bis(p-bromophenyl)aminocinnamic acid
1-(4-diphenylamino)naphthacrylic acid
4-(diphenylamino)styrene
4-(di-p-anisylamino)styrene
4,4'-bis(diethylamino)-2,2'-dimethyltriphenylmethane
1,3,5-triphenyl-2-pyrazoline
β,β-bis(4-dimethylaminophenyl)styrene
2-(p-dimethylaminostyryl)furan
4-dimethylamino-2,5-distyryl furan
1,2,3-triphenylisoindole
1,2,4,5-tetraphenylimidazole
4,4'-bis(diphenylamino)chalcone
4-diphenylaminochalcone
4-carboxytriphenylamine
4-diphenylaminocinnamic acid
tetrakis(4-diethylaminophenyl)-1,4,-xylylene
tetrakis(N-ethyl-N-benzylaminophenyl)-1,4-xylylene
4,4'-bis-(diethylamino)-1,1,1-triphenylethane
4-diethylaminotetraphenylmethane
4,4'-bis-(diethylamino)tetraphenylmethane
4-dimethylaminotetraphenylmethane
tetrakis(4-dimethylaminophenyl)methane
4-diisopropylaminotetraphenylmethane
4-dibenzylaminotetraphenylmethane
2-methyl-4-diethylaminotetraphenylmethane
3-methyl-4-diisopropylaminotetraphenylmethane
4-trityl-N,N-dimethyl-α-naphthylamine
4-trityl-N,N-diethyl-α-naphthylamine
3,3'-bis(1,5-diphenyl-2-pyrazoline)
1-ethylpiperidine
N,N-diethyl-N-(p-tolylazophenyl)amine
p-ditolylaminohydrocinnamic acid
N,N-diethylaniline
1,1-bis[4-(N-ethyl-N-hydroxyethylamino)-2-methylphenyl]isobutane
1,1-bis[4-(N-ethyl-N-hydroxyethylamino)phenyl]cyclohexane
methyl-N,N-p-ditolylaminohydrocinnamate
4-acetyltriphenylamine
4-hexanoyltriphenylamine
4-(p-diphenylaminophenyl)-3-buten-1-yne
1,1-bis(p-ditolylaminophenyl)cyclohexane
N,N-dimethyl-N-p-(2-quinolinylethenyl)phenylamine julolidine
N,N-diethyl-N-p-(N'-ethyl-N'-tolylamino)phenylazophenylamine
N,N-diethyl-N-(6-methyl-4-oxo-4(H)-2-pyranylethenylphenyl)amine
N,N-dimethyl-N-(6-methyl-4-oxo-4(H)-2-pyranylethenylphenyl)amine
3,3'-bis[1-(4-tolyl)-5-phenyl-2-(4H)-pyrazoline]
4-(α-hydroxyethyl)triphenylamine
4-hydroxymethyltriphenylamine
4,4',4''-trimethoxytriphenylamine
4-carbethoxytriphenylamine
3-(p-diphenylamino)phenyl propionic acid
methyl-3-(p-diphenylaminophenyl)propionate
1,1-bis-(4-N,N-diethylaminophenyl)cyclohexane
tris(4-N,N-diethylamino-2-methylphenyl)methane
1,1-bis(4-di-p-tolylaminophenyl)-2-methylpropane
N-vinylditolylamine
N-vinyldiphenylamine
N-ethylditolylamine
bijulolidyl
methyl-p-diphenylaminobenzoate
p-diphenylaminocinnamoyl chloride
3-(p-diphenylaminophenyl)-2-butenoic acid
4',4''-dibromo-4-formyltriphenylamine
p-(N-methyl-N-phenyl)aminobenzaldehyde
2-methoxytriphenylamine
4-acetyltriphenylamine oxime
N-methyl-N,N-p-isobutyldiphenylamine
N-methyl-N,N-p-cyclopentyldiphenylamine
N,N-p-isobutyldiphenyl-N-tolylamine
1,1-bis(4-N,N-diethylamino-2-methylphenyl)isobutane triphenylamine
1,1-bis(4-N-methyl-N-phenylaminophenyl)isobutane
1,1-bis(4-N-methyl-N-phenylaminophenyl)ethane; and
1,1-bis(4-N,N-diethylamino)-2,2'-dimethyltriphenylethane.

The compounds of Table I may be converted for example to acids, alcohols, aldehydes, ketones, amines, etc., to facilitate conversion to polyesters, polycarbonates, vinyl polymers, polyamides, etc. Organic reactions which are useful in this regard are disclosed, for example, in U.S. Pat. Nos. 3,567,450; 3,658,520 and 3,767,393. Useful reaction schemes such as aldol condensation; Friedel-Crafts acylation; Reppe vinylation of nitrogen, oxygen or sulfur compounds; Ulmann phenylanthranilic acid synthesis; Vilsmeier formylation and Wittig reaction are disclosed in *Organic Name Reactions* by Helmut Krauch and Werner Kunz, 2nd Ed., (1964), published by J. Wiley Co.

Polymerization of the Table I materials which have been converted as described above can be carried out according to well known methods such as described in *Preparation Methods of Polymer Chemistry* by Sorenson and Campbell, 2nd Ed., 1968 published by Interscience Co. Best results are obtained with polymers which are insoluble in carrier liquids used to form electrophoretic migration imaging dispersions. Accordingly, the useful molecular weight of the useful polymers will vary depending upon the particular carrier liquid chosen.

Representative polymers having repeating units derived from Table I materials are listed in Table II. In the following tables, the symbol Me represents $CH_3$ and Et represents $C_2H_5$.

TABLE II

1. Poly(di-p-tolylaminostyrene)

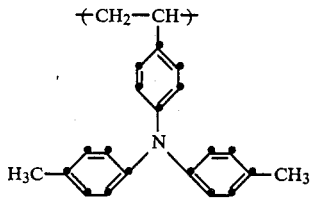

2. Poly(di-p-tolylaminostyrene-co-acrylic acid)

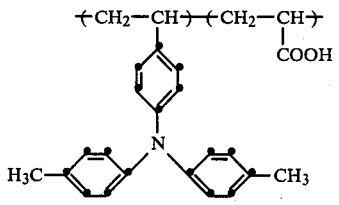

3. Poly[di-p-tolylaminostyrene-co-lauryl methacrylate]

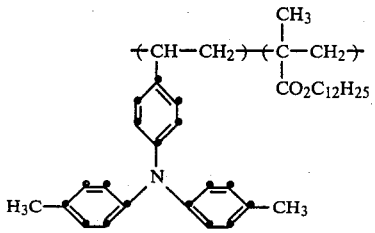

4. Poly[di-p-tolylaminostyrene-co-lauryl methacrylate-co-acrylic acid]

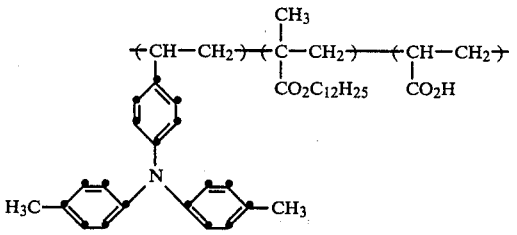

5. Poly(di-p-tolylaminostyrene-co-lauryl methacrylate-co-lithium acrylate)

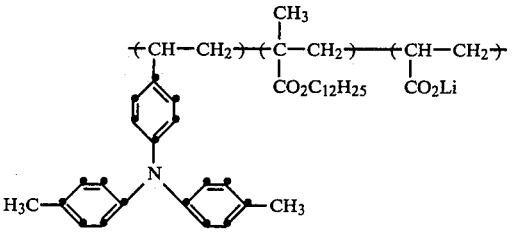

6. Poly(di-p-tolylaminostyrene-co-lauryl methacrylate-co-lithium methacrylate-co-methacrylic acid)

TABLE II-continued

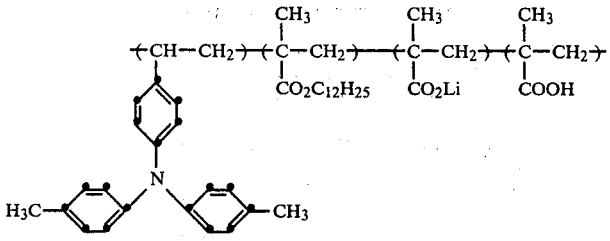

7. Poly(di-p-tolylaminostyrene-co-lauryl methacrylate-co-acrylic acid-co-lithium acrylate)

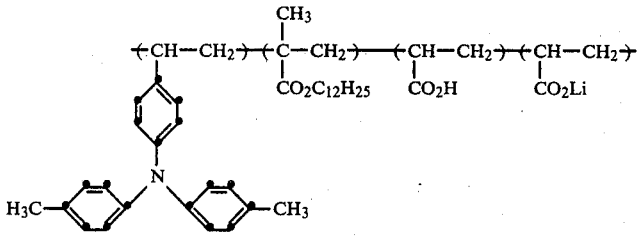

8. Poly[di-p-tolylaminostyrene-co-p-methylstyrene-co-lauryl methacrylate-co-acrylic acid]

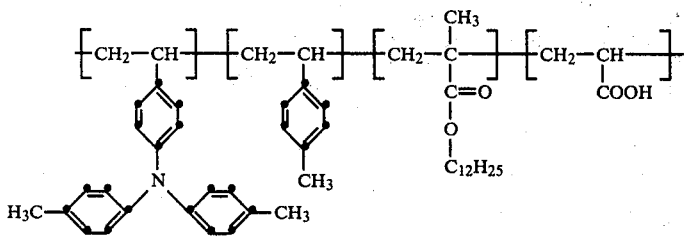

9. Poly[di-p-tolylaminostyrene-co-m-methylstyrene-co-lauryl methacrylate-co-acrylic acid]

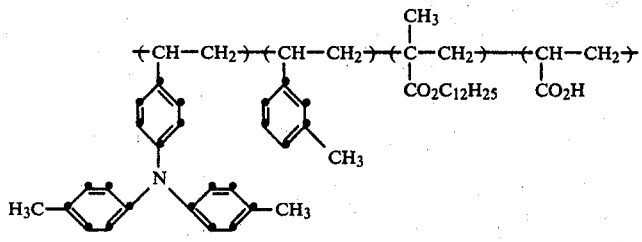

10. Poly[di-p-tolylaminostyrene-co-lauryl methacrylate-co-2-oxo-1-pyrrolidinylethylene]

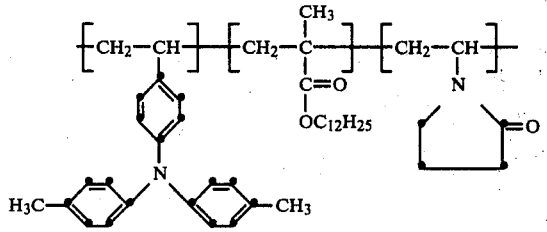

11. Poly[4,4'-bis(N-ethyl-N-trimethyleneamino)-2,2'-dimethyltriphenylmethane]

TABLE II-continued

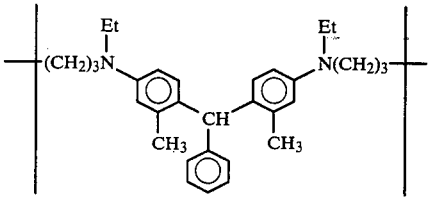

12. Bis-4(N,N-diethylamino-2-methylphenyl)-1-naphthylmethane formaldehyde resin

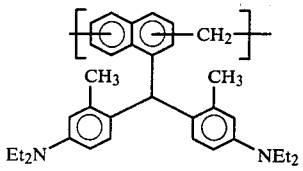

13. Poly[4,4'-bis(N-ethyl-N-ethyleneamino)-2,2'-dimethyltriphenylmethane terephthalate]

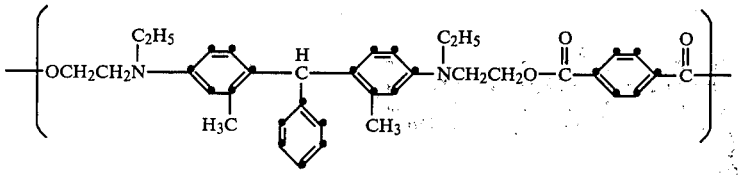

14. Poly[4,4'-bis(N-ethyl-N-ethyleneamino)-2,2'-dimethyltriphenylmethane-1,4-cyclohexanedicarboxylate]

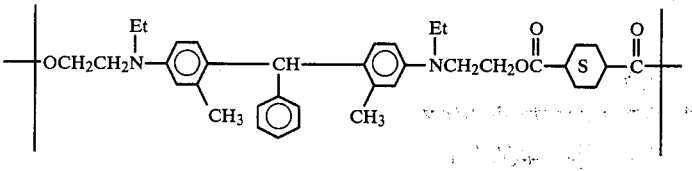

15. Poly[4,4'-bis(N-ethyl-N-ethyleneamino)-2,2'-dimethyltriphenylmethane ditolylaminobenzylmalonate]

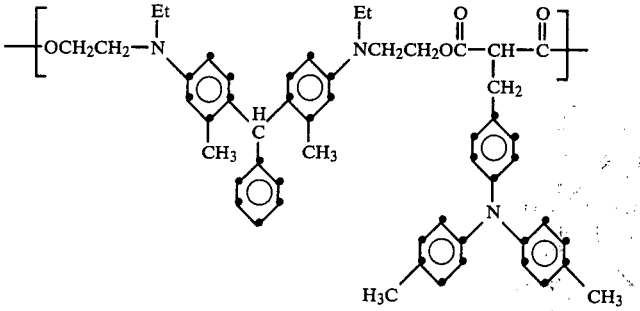

16. Poly[4,4'-bis(N-ethyl-N-ethyleneamino)-2,2'-dimethyl-4''-methoxytriphenylmethane carbonate]

TABLE II-continued

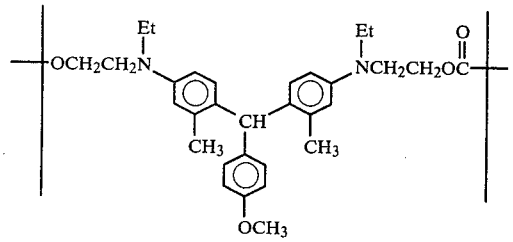

17. Poly[4,4'-bis(N-ethyl-N-ethyleneamino)-2,2'-dimethyltriphenylmethane-2,5-diphenyl-3,4-pyrroledicarboylate]

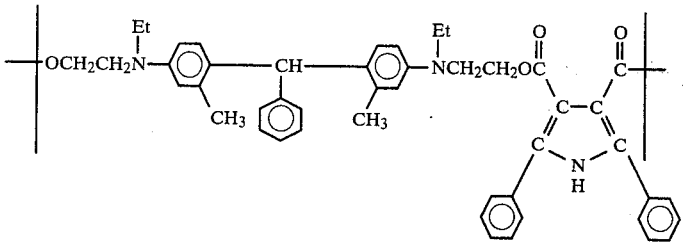

18. Poly[bis(4-N,N-diethylamino-2-methylphenyl) methylene-p-phenyl methacrylate]

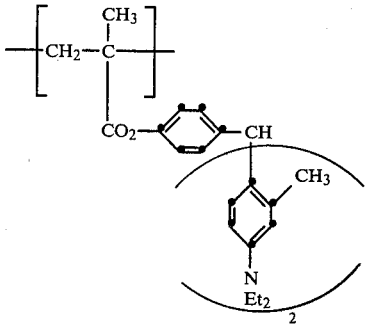

19. Poly[bis(4-N,N-diethylamino-2-methylphenyl)-methyl-p-phenoxyethyl methacrylate]

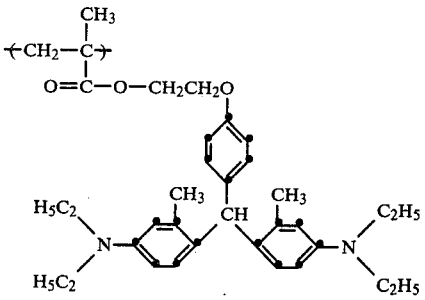

20. Poly[bis(4-N,N-diethylamino-2-methylphenyl) methylene-p-phenyl methacrylate-co-lauryl methacrylate-co-acrylic acid]

TABLE II-continued

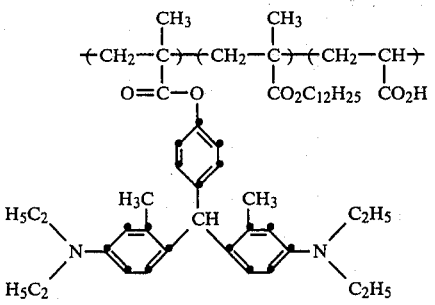

21. Poly[bis(4-N,N-diethylamino-2-methylphenyl) methyl-p-phenoxyethyl methacrylate-co-lauryl methacrylate-co-lithium methacrylate-co-methacrylic acid]

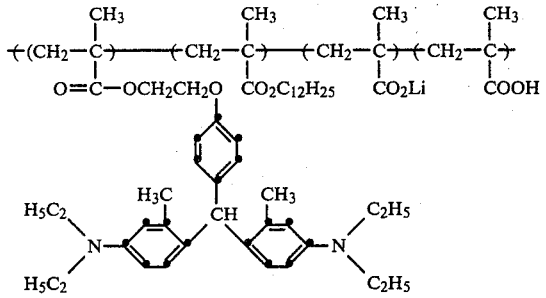

22. Poly[1,1-bis(4-[N-ethyl-N-ethyleneamino]-2-methylphenyl)isobutylidene terephthalate]

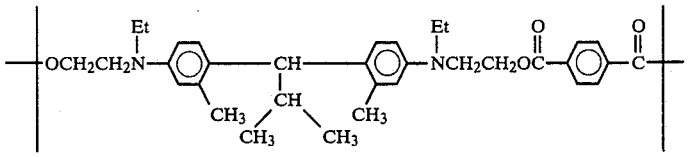

23. Poly(triphenylamine)

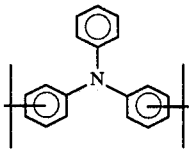

24. Triphenylamine-p-N,N-diethylamino-benzaldehyde resin

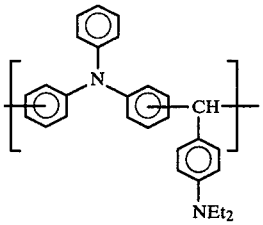

25. Triphenylamine-p-(di-4-tolylamino) benzaldehyde resin

TABLE II-continued
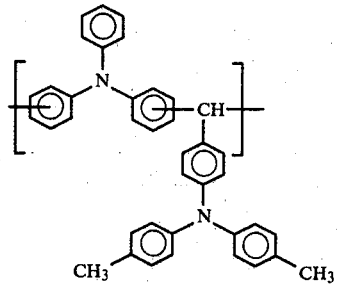
26. Poly[1,4-cyclohexanedimethylene-di-p-tolylaminobenzyl malonate]
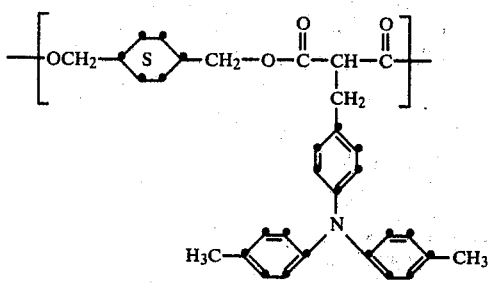
27. Poly[1,4-cyclohexanedioxyethylene-di-p-tolylaminobenzyl malonate]
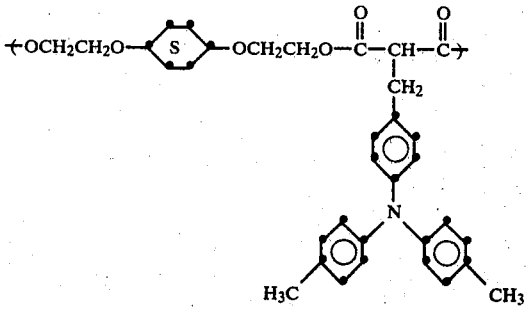
28. Poly[benzoylethylene-co-di-p-tolylaminobenzoylethylene]
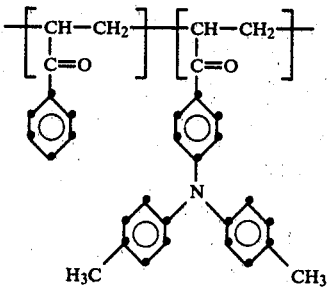
29. Poly[2,2-dimethyltrimethylene-2,5-diphenyl-3,4-pyrroledicarboxylate]

TABLE II-continued
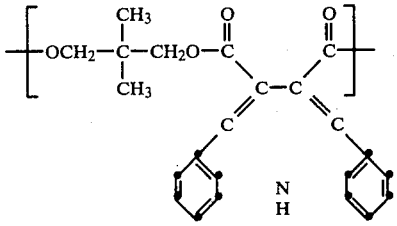
30. Poly[tetramethylene-2,5-diphenyl-3,4-pyrroledicarboxylate]
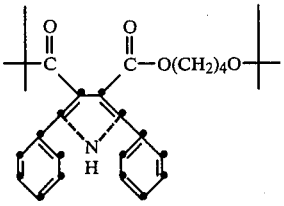
31. Poly[1-phenyl-3(4-ethyleneoxystyryl)-5-(4-ethyleneoxyphenyl)-2-pyrazoline]
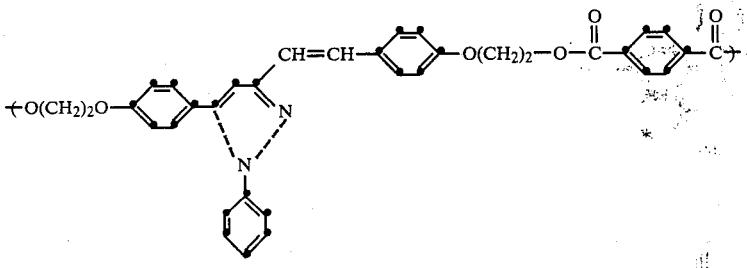
32. Poly(2,2-dimethyltrimethylene-co-decamethylene 2,5-diphenylpyrrole-3,4-dicarboxylate)
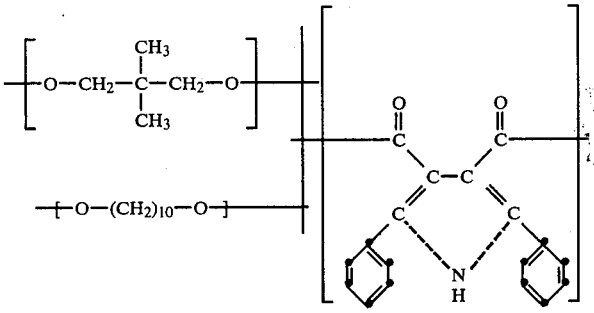
33. Poly[4-diethyleneamine tetraphenylmethane terephthalate]
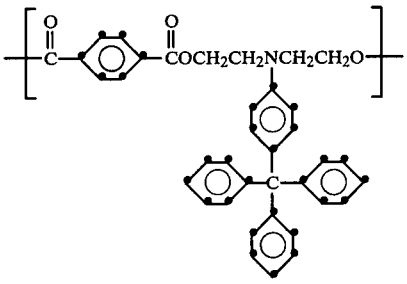

TABLE II-continued

34. α-N-methylanilino-4-phenyl-ω-N-methylanilino-α-methylbenzyl poly[ethylidenephenyl-4(N-methylamino-1,4-phenylene)]

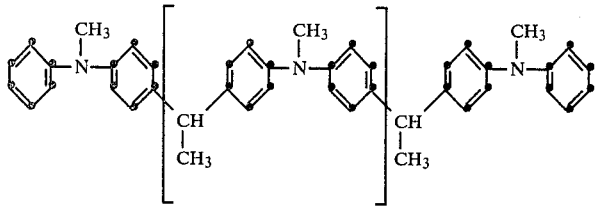

35. Poly[1,1-bis(4-[N-ethyl-N-ethyleneamino]phenyl) cyclohexylidene carbonate]

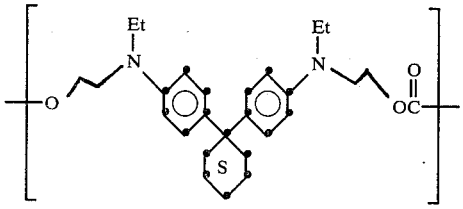

36. Poly[1,1-bis(4-[N-ethyl-N-ethyleneamino-2-methyl]phenyl)-2-phenylethane carbonate]

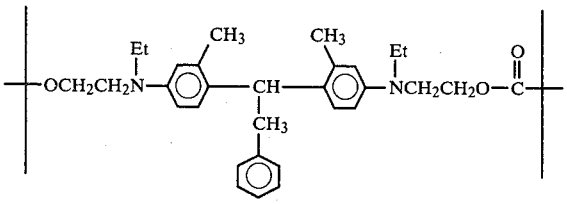

A wide variety of colorants will be useful in combining with the described polymeric binders to form the electrically photosensitive particles of the present invention. Useful colorants may or may not be electrically photosensitive. In some of the binder-colorant combinations of this invention, the colorant by itself is not electrically photosensitive. However when such colorants are combined with the binder described herein, a composite particle which is electrically photosensitive results. Accordingly, the binder-colorant combinations of the composite particles of the present invention become electrically photosensitive even when the colorants are not.

A partial listing of representative electrically photosensitive colorants include the following materials disclosed in the indicated volumes of *Research Disclosure.* Each of the enumerated *Research Disclosures* (1 through 10) are expressly incorporated herein by reference.

(1) Aromatic vinyl (including bis vinyl) condensed heterocyclic nitrogen colorants described in *Research Disclosure* Item 15028, page 39, Volume 150, October, 1976.

V.

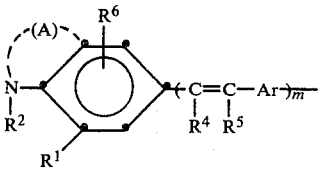

-continued

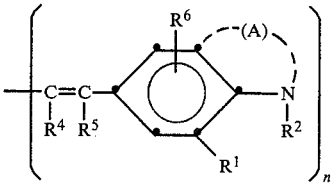

wherein:

n represents 0 or 1;

m represents the integer 1 or 2;

Ar represents a substituted or unsubstituted, carbocyclic or heterocyclic aromatic ring group, free from any saturated N-heterocyclic ring group fused thereto, and preferably having 6 to about 20 ring atoms in the aromatic ring, e.g., phenyl, naphthyl, anthryl, etc;

A represents a substituted or unsubstituted alkylene group having 2 to about 5 carbon atoms in the alkylene chain;

each of $R^1$ and $R^2$, when taken together, represent a substituted or unsubstituted alkylene group containing 2 to about 5 carbon atoms in the alkylene chain;

each of $R^1$, $R^4$, $R^5$ and $R^6$, when taken alone, represent hydrogen, nitro, cyano, a halogen such as fluorine, chlorine, bromine or idoine, an alkoxy having 1 to about 8 carbon atoms, a substituted or unsubstituted alkyl having 1 to about 8 carbon atoms in the alkyl group, a substituted or unsubstituted phenyl group, a carboxy ester having 1 to about 4 carbon atoms, an amide having the formula $—CONR_2^7$ wherein $R^7$ represents hydrogen or a substituted or unsubstituted alkyl or a substituted or unsubstituted aryl as defined immediately hereinabove; and $R^2$, when taken alone, represents hydrogen, a substituted or unsubstituted alkyl having 1 to about 8 carbon atoms in the alkyl group thereof, substituted or unsubstituted carbocyclic or heterocyclic aromatic ring group having 6 to about 20 carbon ring atoms.

Compounds 30 through 32 of Table III are examples of the compound of general formula V.

(2) Aromatic vinyl (including bis vinyls) arylamines or N-containing heterocyclics described in *Research Disclosure* Item 15029, page 51, Volume 150, October, 1976.

VI.

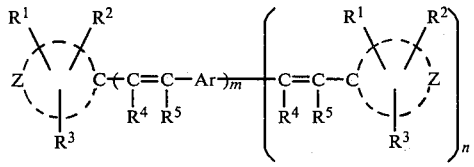

wherein:

n represents 0 or 1;

m represents the integer 1 or 2;

Ar represents a substituted or unsubstituted carbocyclic or heterocyclic aromatic ring group, preferably having 6 to about 20 ring atoms in the aromatic ring, e.g., phenyl, naphthyl, anthryl, etc;

Z represents the nonmetallic atoms necessary to complete a carbocyclic or heterocyclic aromatic ring group, preferably having 5 to about 14 ring atoms in the aromatic ring, e.g., phenyl, anthryl, carbazole, pyrrole, etc;

each of $R^1$, $R^2$, $R^3$, $R^4$ and $R^5$, which are the same or different, when taken alone, represents hydrogen, nitro, cyano, a halogen such as fluorine, chlorine, bromine or iodine, an alkoxy preferably having 1 to about 8 carbon atoms, a substituted or unsubstituted alkyl having 1 to about 8 carbon atoms in the alkyl group, a substituted or unsubstituted carbocyclic or heterocyclic aromatic ring group having 5 to about 14 carbon atoms in the aromatic ring, e.g., benzisoxazole, a carboxy ester having 1 to about 4 carbon atoms, an amide having the formula $—CONR_2^6$ wherein $R^6$ represents hydrogen or a substituted or unsubstituted aromatic ring group or a substituted or unsubstituted alkyl as defined immediately hereinabove, an amino, preferably saturated heterocyclic amino groups containing 5 to about 8 ring atoms such as pyrrolidinyl, piperidino, morpholino, etc, dialkylamino, diarylamino, dialkarylamino such as ditolylamino, or diaralkylamino such as dibenzylamino wherein the alkyl group contained in such amino is preferably a lower alkyl having 1 to about 8 carbon atoms and the aryl group contained in such amino is, for example, phenyl, naphthyl, etc; and each of $R^1$, $R^2$ and $R^3$, when taken together, is free from any saturated N-heterocyclic ring group fused to the aromatic ring group formed by Z.

A variety of different substituents can be present in the above-defined formula in the case where Ar represents a substituted aromatic group. In general, the substituents on Ar can be selected from the same class of substituent groups defined above for $R^1$, $R^2$, $R^3$, $R^4$ and $R^5$.

Compounds 33 through 35 of Table III are examples of formula VI materials.

(3) Merocyanines including bis-merocyanines, benzylidenes including bis-benzylidines, or mixed merocyaninebenzylidene colorants havng a pyran, thiopyran, selenopyran, or 1,4-dihydroxy pyridine nucleus. U.S. Pat. No. 4,145,215, granted Mar. 20, 1979 to VanAllan et al. *Research Disclosure* Item 16247, page 126, Volume 162, October, 1977.

VII.

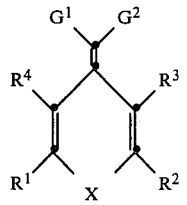

wherein:

$G^1$ and $G^2$, which are the same or different, represent (1) an electron withdrawing group such as cyano, acyl, alkoxycarbonyl, nitroaryl, alkylsulfonyl, arylsulfonyl, fluorosulfonyl, and nitro, or (2) when taken together with the carbon atom to which they are attached, $G^1$ and $G^2$ represent the nonmetallic atoms needed to complete a substituted or unsubstituted acidic cyclic nucleus of the type used in merocyanine dyes such as indan-1,3-dione; cyclohexane-1,3-dione; 5,5-dimethylcyclohexane-1,3-dione; and 1,3-dioxan-4,6-dione, etc, or (3) an acidic heterocyclic nucleus containing from 5 to 6 atoms in the heterocyclic ring;

X may be O, S, Se or NR in which R represents a substituted or unsubstituted alkyl, aryl, aralkyl, cycloalkyl, alkenyl or alkynyl, and said substituents are selected from the group consisting of hydroxy, alkoxy, aryloxy or halogen;

$R^1$ and $R^2$, which are the same or different, represent alkyl, aryl, $—CL^1(=CL^2—CL^3)_m=A^1$, $—CL^4=CL^5(—CL^6=CL^7)_n—$ $A^2$ or $R^1$, together with $R^4$, or $R^2$, together with $R^3$, represent sufficient atoms to complete an alkylene bridge;

$A^2$ is the same as $A^1$ and, in addition, represent a substituted or unsubstituted aryl group (e.g., phenyl, naphthyl, anthryl), or a substituted or unsubstituted heterocyclic nucleus such as thiophene, benzo[b]thiophene, naphtho[2,3-b]thiophene, furan, isobenzofuran, chromene, pyran, xanthene, pyrrole, 2H-pyrrole, pyrazole, indolizine, indoline, indole, indazole, carbazole, pyrimidine, isothiazole, isoxazole, furazan, chroman, isochroman, 1,2,3,4-tetrahydroquinoline, 4H-pyrrole[3,2,1-ij]quinoline, 1,2-dihydro-4H-pyrrolo[3,2,1-ij]quinoline; 1,2,5,6-tetrahydro-4H-pyrrolo[3,2,1-ij]quinoline; 1H,5H-benzo[ij]quinolizine; 2,3-dihydro-1H,5H-benzo[ij]quinolizine; 2,3-dihydro-1H,5H-benzo[ij]quinolizine and 2,3,6,7-tetrahydro-1H,5H-benzo[ij]quinolizine, 10,11-dihydro-9H-benzo[a]xanthene-6,7-dihydro-5H-benzo[b]pyran;

$R^3$ represents hydrogen or $R^3$, together with $R^2$, $L^1$ or $L^4$ and the carbon atoms to which they are attached, represent a 5- or 6-membered carbocyclic ring;

$R^4$ is the same as $R^3$ when taken alone or together with $R^1$, $L^1$ or $L^4$;

m and n are 0, 1 or 2;

$L^1$, $L^2$, $L^3$, $L^4$, $L^5$, $L^6$ and $L^7$ represent hydrogen, alkyl and aryl; $L^1$ or $L^4$, together with either $R^3$ or $R^4$, represent the atoms needed to complete a carbocyclic ring; and $A^1$ represents a basic substituted or unsubstituted heterocyclic nucleus of the type used in cyanine dyes.

Colorants 36 through 40 of Table III are examples of formula VII materials.

(4) Merocyanines or benzylidine colorants containing an isoxozolone nucleus described in *Research Disclosure* Item 16259, page 61, Volume 162, October, 1977.

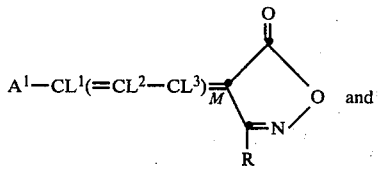
VIII.

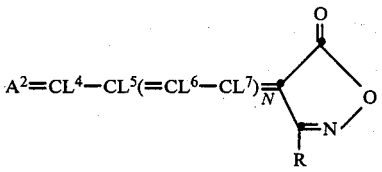
IX.

wherein:

M and N represent 0, 1 or 2;

$L^1$ through $L^7$ represents hydrogen, alkyl, aralkyl, aryl, and in addition any two of $L^1$, $L^2$ and $L^3$ and any two of $L^4$, $L^5$, $L^6$ and $L^7$ can together represent the elements needed to complete a carbocyclic ring;

R represents alkyl, aryl, hydrogen, etc;

$A^1$ is the same as $A^2$ and, in addition, represents an aryl group (e.g., phenyl, naphthyl, anthryl) or a substituted or unsubstituted heterocyclic nucleus such as thiophene, benzo[b]thiophene, naptho[2,3-b]thiophene, furan, isobenzofuran, chromene, pyran, xanthene, pyrrole, 2H-pyrrole, pyrazole, indolizine, indoline, indole, indazole, carbazole, pyrimidine, isothiazole, isoxazole, furazan, chroman, isochroman, 1,2,3,4-tetrahydroquinoline, 4H-pyrrolo[3,2,1-ij]quinoline, 1,2-dihydro-4H-pyrrolo[3,2,1-ij]quinoline; 1,2,5,6-tetrahydro-4H-pyrrolo[3,2,1-ij]quinoline; 1H,5H-benzo[ij]quinolizine; 2,3-dihydro-1H,5H-benzo[ij]quinolizine; 2,3-dihydro-1H,5H-benzo[ij]quinolizine and 2,3,6,7-tetrahydro-1H,5H-benzo[ij]quinolizine; 10,11-dihydro-9H-benzo[a]xanthene; 6,7-dihydro-5H-benzo[b]pyran; and $A^2$ represents a basic substituted or unsubstituted heterocyclic nucleus of the type used in cyanine dyes.

Colorants 41 through 44 are examples of formulas VIII and IX materials.

(5) Merocyanine or benzylidene colorants containing malononitrile or cyanomethylene substituents described in *Research Disclosure* Item 16257, page 75, Volume 162, October, 1977.

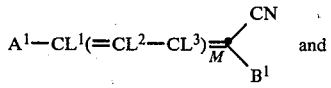
X.

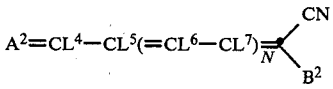
XI.

wherein:

$B^1$ and $B^2$ represent any of a wide variety of electronegative groups such as cyano, carboxy, alkoxy, carbonyl, aryloxycarbonyl, alkylsulfonyl, acyl, arylcarbonyl, heteroyl groups such as benzofuroyl, nitro, nitrosubstituted aryl, sulfonyl, fluorosulfonyl, trifluoromethylsulfonyl, carbamoyl, arylcarbamoyl, alkylcarbamoyl, etc; and $A^1$, $A^2$, $L^1$ through $L^7$, M and N are substantially the same as for formulas VIII and IX.

Compounds 45 through 47 of Table III are examples of formulas X and XI materials.

(6) Merocyanine or benzylidene colorants containing a barbituric or thiobarbituric acid nucleus described in *Research Disclosure* Item 16323, page 19, Volume 163, November, 1977.

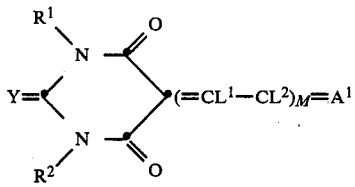
XII.

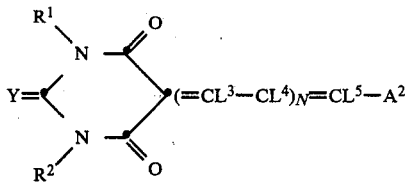
XIII.

wherein:

M and N are 0, 1, 2 or 3;

$R^1$ and $R^2$ are the same or different and each may represent a hydrogen, alkyl or aryl group;

Y represents O or S;

$L^1$, $L^2$, $L^3$, $L^4$ and $L^5$ represent hydrogen, alkyl or aryl, and in addition either $L^1$ and $L^2$ or any two of $L^3$, $L^4$ and $L^5$ together represent the elements needed to complete a carbocyclic ring, and $A^1$ and $A^2$ are substantially as defined for formulas VII, VIII and IX.

Colorants 48 through 50 of Table III are examples of formulas XII and XIII.

(7) Allopolar colorants described in *Research Disclosure* Item 16324, page 33, Volume 163, November, 1977.

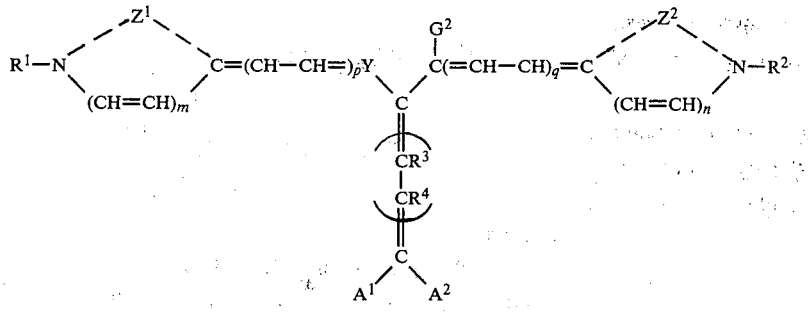

XIV.

wherein:

Y represent N or a methine carbon C—$G^1$;

$G^1$ and $G^2$ are the same or different and each is H, alkyl, or aryl or taken together complete a carbocyclic ring;

$Z^1$ and $Z^2$ are the same or different and each represents the nonmetallic atoms necessary to complete a basic heterocyclic nucleus of the type used in cyanine dyes containing 5 to 14 atoms in the heterocyclic ring;

$A^1$ and $A^2$, which are the same or different, and each may represent alkyl, aryl, carboxy, alkoxycarbonyl, cyano, nitro, etc, or together may complete an acidic nucleus of the type used in merocyanine dyes such as an indandione nucleus (e.g., 1,3-diketohydrindene, pyrazolinone, isoxazolone, oxindole, 2,4,6-triketohexahydropyrimidine, rhodanine, 2(3H)-imidazopyridone, 2-thio-2,4-oxazolidinedione, 2-thio-2,5-thiazolidinedione, 2,4-thiazolidenedione, thiazolidinone, 2-imino-2,4-oxazolinone, 2,4-imidazolidinedione, 2-thio-2,4-imidazolidine, 5-imidazolinone, pyrazolidindione, 5-anthrone, 1,3-dioxan-4,6-dione, isoxazolinone, pyrrolo[1,2-]pyrimidin-2,4-dione, indolinone, indolinthione, and 1,3-isoquinolinedione;

$R^1$ and $R^2$ are the same or different and each may represent H, alkyl, aralkyl or aryl;

$R^3$ and $R^4$ represent hydrogen, alkyl, aryl, cyano or, taken together, represent a 5- to 6-member carbocyclic ring;

m and n are the same or different and may be 0 or 1; and p, q and r are the same or different and may be 0, 1 or 2.

Colorants 51 through 54 of Table III are examples of formula XIV materials.

(8) Aryl substituted vinyl colorants, including arylene substituted bisvinyl, dibenzothienyl substituted vinyl and dibenzothien-diyl substituted bisvinyl colorants described in *Research Disclosure* Item 16626, page 29, Volume 166, February, 1978.

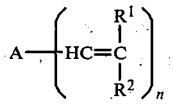

XV.

wherein:

n equals 1 or 2;

A represents phenylene, naphthylene, anthracenyl, anthracenediyl, and dibenzothiendiyl;

$R^1$ and $R^2$, which are the same or different, when taken alone, represent hydrogen, cyano, alkylsulfonyl, alkylcarbonyl and arylcarbamoyl, cyanoaryl, and arylcarbonyl;

$R^1$ and $R^2$, when taken together, represent sufficient atoms to form substituted and unsubstituted radicals selected from the group consisting of furanylidene, fluorenylidene, pyrimidinylidene, thiazolidinylidene, pyrrolinyl, and indenyl, isoxazolinylidene, pyrazolinylidene, indanylidene and dithiolyl, wherein said substituents are selected from the group consisting of hydrogen, cyano, aryl, oxo, thioxo, nitro, alkyl, nitroaryl, carbamoyl, and cyanoalkyl, except that when:

(a) A represents anthracene nucleus;

(i) $R^1$ and $R^2$, when taken together, represent 1,3,5-trihydro-2,4,6-trioxo-pyrimidin-5-ylidene; 3-cyano-4-phenyl-2-oxo-pyrrolin-5-ylidene; or 3-carboxy-inden-1-ylidene; or (ii) taken alone, $R^1$ represents cyano and $R^2$ represents methylsulfonyl, ethoxycarbonyl, or phenylcarbamoyl, then n represents 2, or (b) A represents phenylene and $R^1$ and $R^2$, taken together, represent 4,5-dicyano-1,3-dithiol-2-ylidene; then n represents 2; or (c) $R^1$ is hydrogen, $R^2$ must be other than hydrogen.

Colorants 55 through 66 of Table III are examples of formula XV materials.

(9) Cyclobutenylium colorants described in *Research Disclosure* Item 17320, page 231, Volume 173, September, 1978.

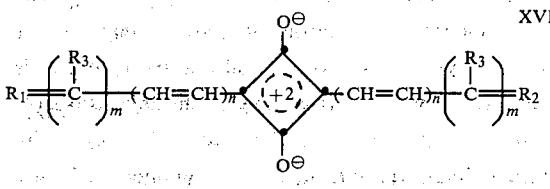

XVI.

wherein:

$R_1$ and $R_2$ are the same or different, represent a monovalent or divalent substituted or unsubstituted 5- to 13-member heterocyclic nucleus, or substituted or unsubstituted 5- to 10-member saturated or unsaturated carbocyclic nucleus, and said hetero atom is selected from the group consisting of O and N;

$R_3$ represents H, alkyl, aryl, or cyano and carboxyesters;

m represents 0 or 1;

n represents 0, 1, 2 or 3; and said substituted $R_1$ and $R_2$ substituents are selected from the group consisting of alkyl, hydroxy, phenyl, oxo, benzyl, carbamoyl, acetamido, nitro, piperidinyl, chloro, substituted amino, e.g., alkylamino or hydroxyalkylamino and hydrogen. Crystalline materials having one of these structures show high photosensitivity in migration imaging processes. Yellow, magenta or cyan materials can be formed in the dissolved state in a polymeric receiver by the appropriate choice of $R_1$ and $R_2$, as well as the substituents for $R_1$ and $R_2$.

Colorants 67 through 69 of Table III are examples of formula XVI materials.

(10) Merocyanine or benzylidene having a quinolinedione or isoquinolinedione nucleus described in *Research Disclosure* Item 17645, page 64, Volume 176, December, 1978.

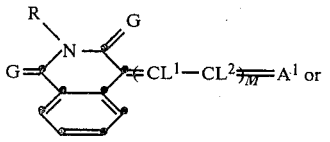

XVII

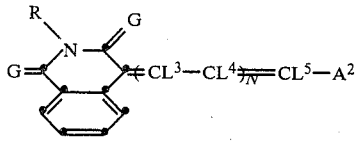

XVIII wherein:

R represents any one of a wide variety of basic heterocyclic nuclei such as defined for $A^1$ below and also represents groups such as hydrogen, substituted or unsubstituted alkyl, aryl, aralkyl, ureido, thioureido, hydroxy, anilino, amidino, etc. (said substituents are groups such as alkoxy, aryloxy, hydroxy, carboxy, cyano, halogens, alkoxycarbonyl, etc);

G represents O or S;

$L^1$, $L^2$, $L^3$, $L^4$ and $L^5$ each represent hydrogen, alkyl or aryl;

M represents 0, 1, 2 or 3;

N represents 0 or 1; and $A^1$ represents a nitrogen-substituted basic heterocyclic nucleus of the type used in cyanine dyes.

Colorants 70 through 72 of Table III are examples of formulas XVII and XVIII materials.

Representative basic heterocyclic nucleus which are useful in forming the colorants of formulas VII, VIII, IX, X, XI, XVII and XVIII include:

(a) imidazole, such as 4-phenylimidazole;

(b) 3H-indole nucleus such as 3H-indole, 3,3-dimethyl-3H-indole, 3,3,5-trimethyl-3H-indole;

(c) a thiazole nucleus such as thiazole, 4-methylthiazole, 4-phenylthiazole, 5-methylthiazole, 5-phenylthiazole, 4,5-dimethylthiazole, 4,5-diphenylthiazole, and 4-(2-thienyl)thiazole;

(d) a benzothiazole nucleus such as benzothiazole, 5-aminobenzothiazole, 4-chlorobenzothiazole, 5-chlorobenzothiazole, 6-chlorobenzothiazole, 7-chlorobenzothiazole, 5-cyanobenzothiazole, 4-methylbenzothiazole, 5-methylbenzothiazole, 6-methylbenzothiazole, 5-bromobenzothiazole, 6-bromobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-methylenedioxybenzothiazole, 5-hydroxybenzothiazole, and 6-hydroxybenzothiazole;

(e) a naphthothiazole nucleus such as naphtho[1,2-d]thiazole, naphtho[2,1-d]thiazole, naphtho[2,3-d]thiazole, 5-methoxynaphtho[2,1-d]thiazole, 5-ethoxynaphtho[2,1-d]thiazole, 8-methoxynaphtho[1,2-d]thiazole, 7-methoxynaphtho[1,2-d]thiazole, and 4,5-dihydronaphtho[1,2-d]thiazole;

(f) a thianaphtheno[7,6-d]thiazole nucleus such as 4-methoxythianaphtheno[7,6-d]thiazole;

(g) an oxazole nucleus such as 4-methyloxazole, 5-methyloxazole, 4-phenyloxazole, 4,5-diphenyloxazole, 4-ethyloxazole, 4,5-dimethyloxazole, and 5-phenyloxazole;

(h) a benzoxazole nucleus such as benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-methoxybenzoxazole, 5-ethoxybenzoxazole, 6-chlorobenzoxazole, 6-methoxybenzoxazole, 5-hydroxybenzoxazole, and 6-hydroxybenzoxazole;

(i) a naphthoxazole nucleus such as naphth[1,2-d]oxazole, naphth[2,1-d]oxazole, and naphth[2,3-d]oxazole;

(j) a selenazole nucleus such as 4-methylselenazole and 4-phenylselenazole;

(k) a benzoselenazole nucleus such as benzoselenazole, 5-chlorobenzoselenazole, 5-methoxybenzoselenazole, 5-hydroxybenzoselenazole, and tetrahydrobenzoselenazole;

(l) a naphthoselenazole nucleus such as naphtho[1,2-d]selenazole, naphtho[2,1-d]selenazole;

(m) a thiazoline nucleus such as thiazoline and 4-methylthiazoline;

(n) a 2-quinoline nucleus such as quinoline, 3-methylquinoline, 5-methylquinoline, 7-methylquinoline, 8-methylquinoline, 6-chloroquinoline, 8-chloroquinoline, 6-methoxyquinoline, 6-ethoxyquinoline, 6-hydroxyquinoline, and 8-hydroxyquinoline;

(o) a 4-quinoline nucleus such as quinoline, 6-methoxyquinoline, 7-methylquinoline and 8-methylquinoline;

(p) a 1-isoquinoline nucleus such as isoquinoline and 3,4-dihydroisoquinoline;

(q) a benzimidazole nucleus such as 1-ethylbenzimidazole and 1-phenylbenzimidazole;

(r) a 2-pyridine nucleus such as pyridine and 5-methylpyridine; and (s) a 4-pyridine nucleus.

Particularly useful colorants are copper phthalocyanine, zinc phthalocyanine, phthalocyanines, methyl quinacridone, dimethyl quinacridone, mixed quinacridones, quinacridones, epindolidiones, naphthyljulolidine, pyrylium, thiopyrylium, acridinium, triarylmethane dyes, methine dyes, styryl dyes, pyridinium, rhodamine salts, merocyanines and cyanine materials. Representative colorants are described in following Table III. In Table III, Me represents $CH_3$ and Et represents $C_2H_5$.

TABLE III

| Colorants | |
|---|---|
| 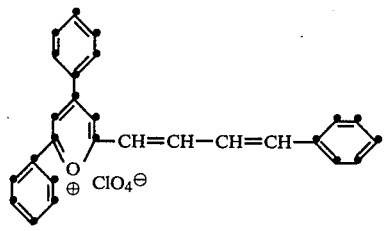 | 1. |

TABLE III-continued
Colorants
2.
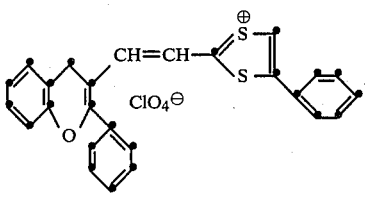
3.
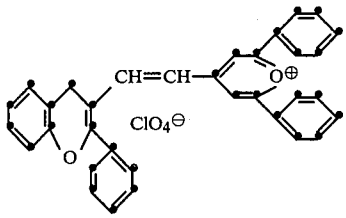
4.
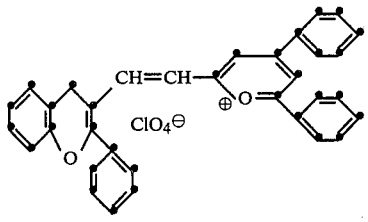
5.
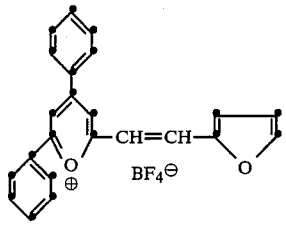
6.
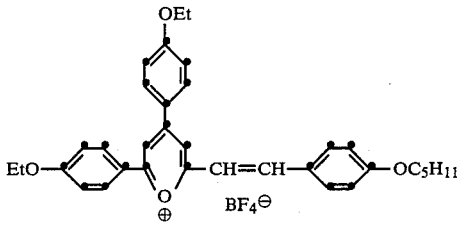
7.
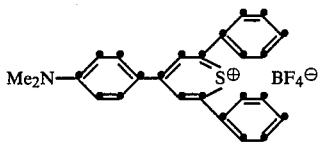
8.
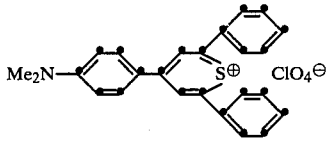
9.
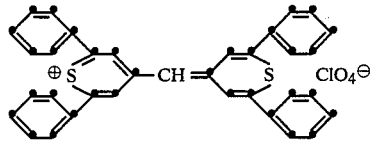
TABLE III-continued
Colorants
10.
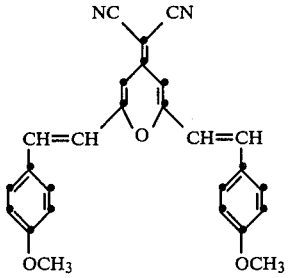
11.
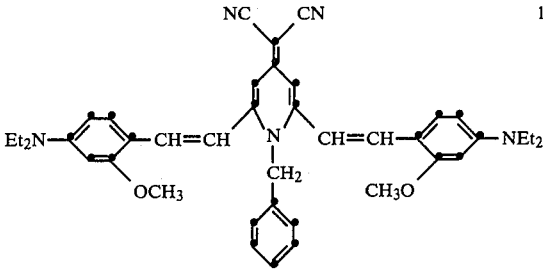
12.
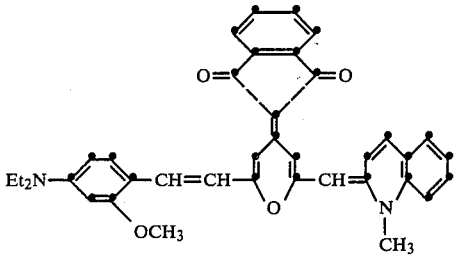
13.
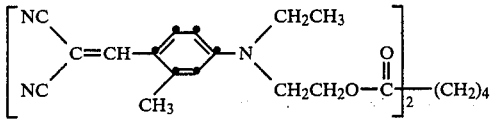
14.
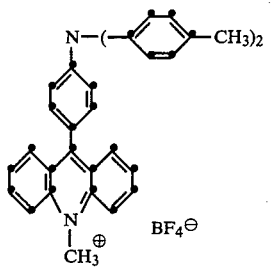
15.
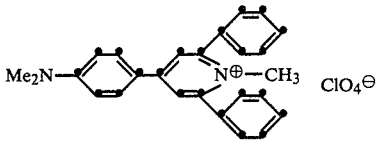
16.
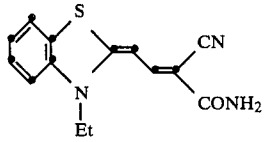
17.
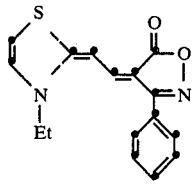

TABLE III-continued
Colorants
18.
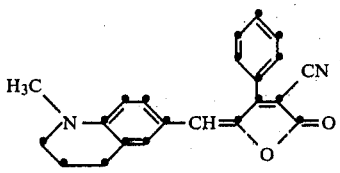
19.
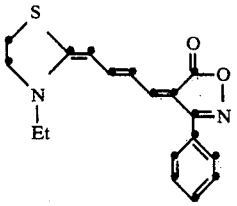
20.
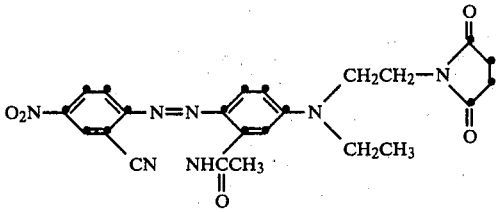
21.
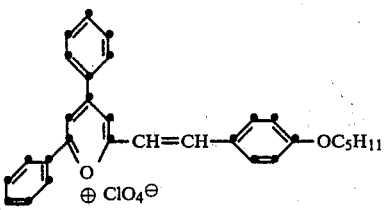
22.
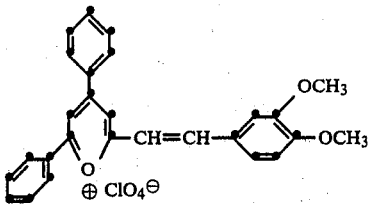
23.
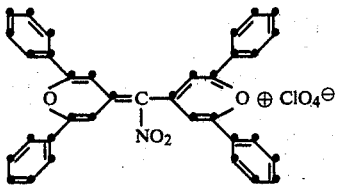
24.
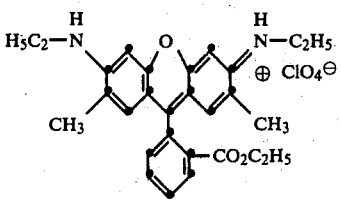
TABLE III-continued
Colorants
25.
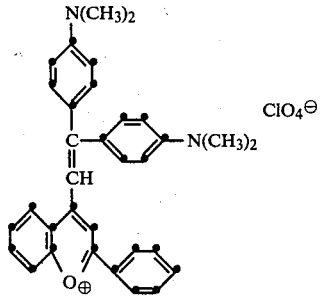
26.
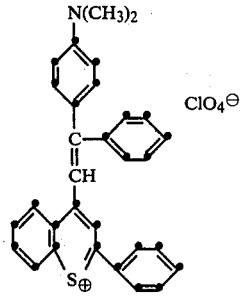
27.
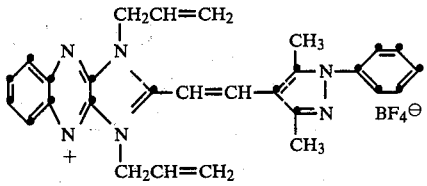
28.
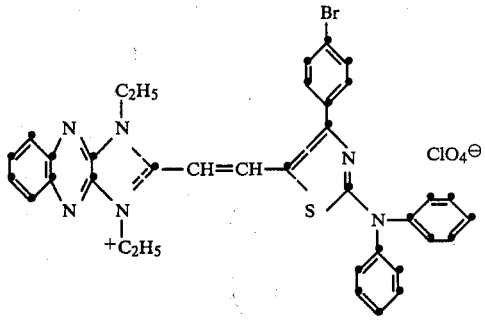
29.
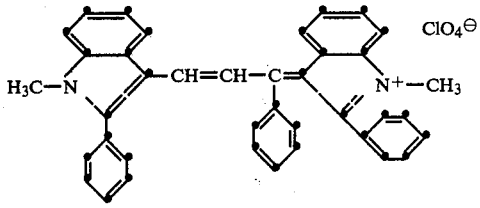
30.
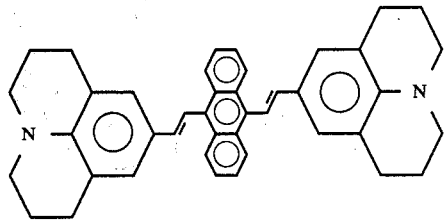

TABLE III-continued
Colorants
31.
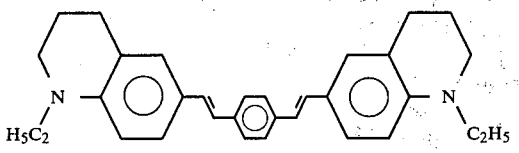
32.
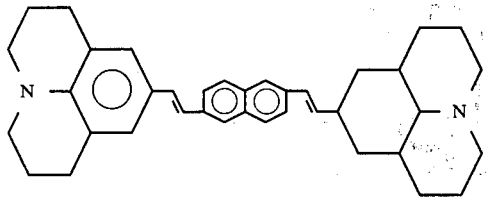
33.
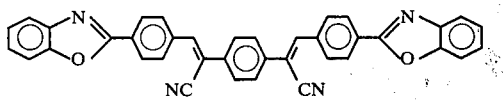
34.
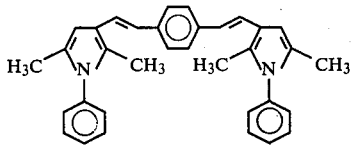
35.
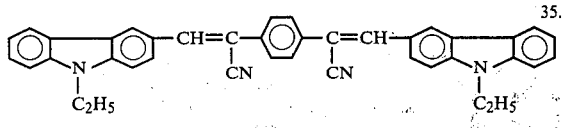
36.
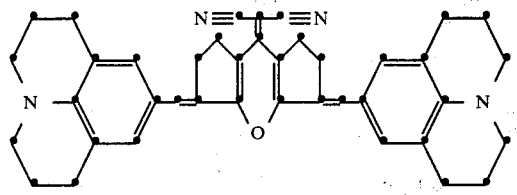
37.
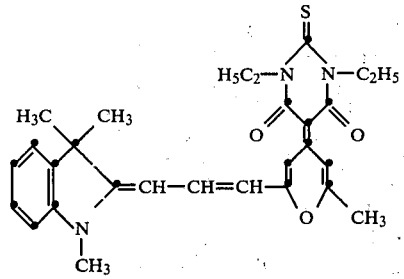
38.
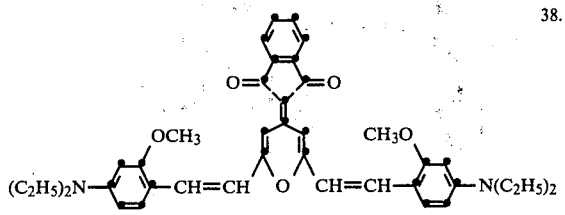
39.
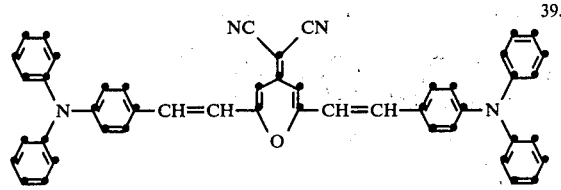
TABLE III-continued
Colorants
40.
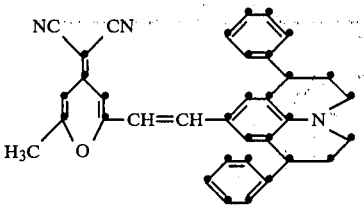
41.
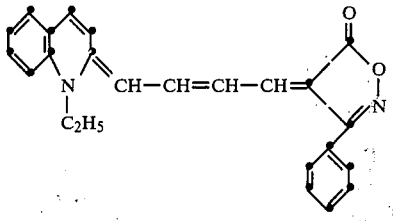
42.
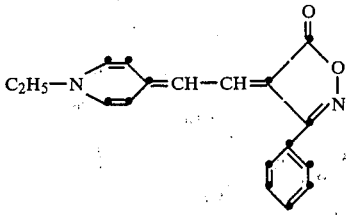
43.
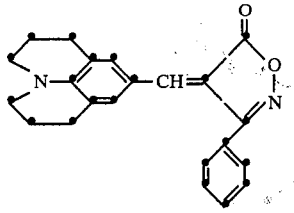
44.
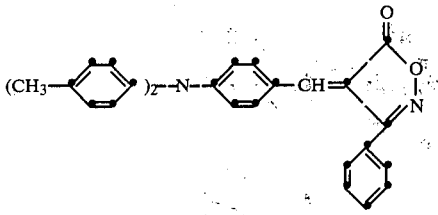
45.
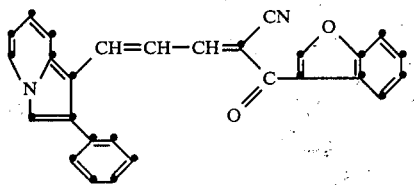
46.
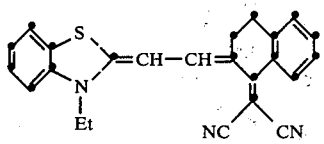
47.
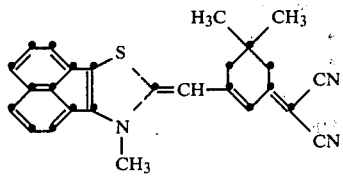

TABLE III-continued
Colorants
48.
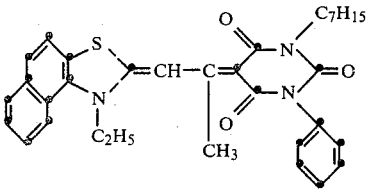
49.
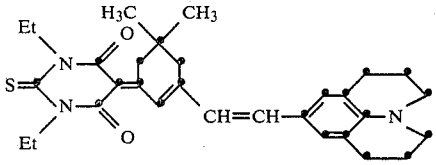
50.
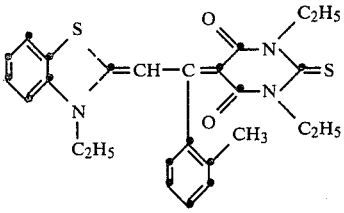
51.
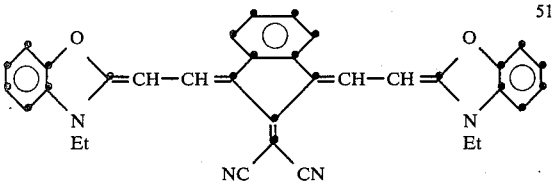
52.
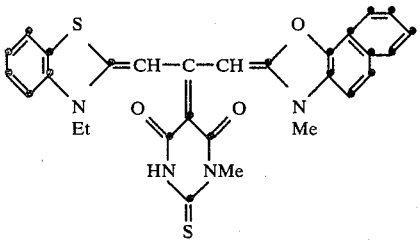
53.
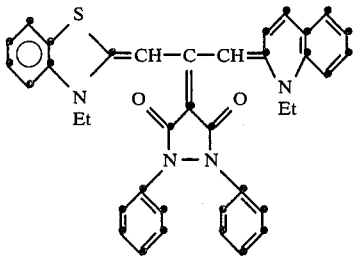
54.
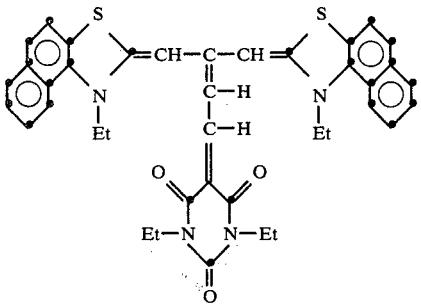
TABLE III-continued
Colorants
55.
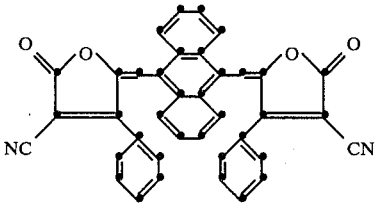
56.
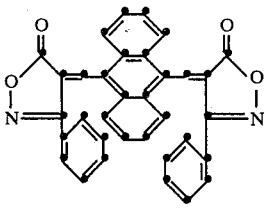
57.
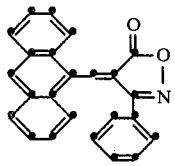
58.
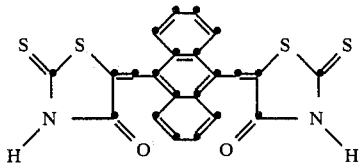
59.
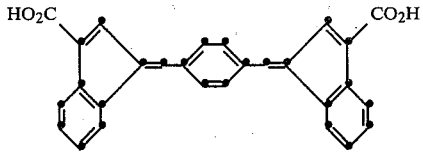
60.
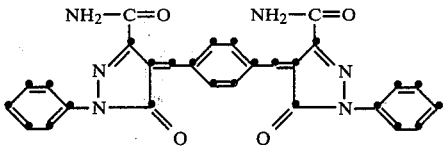
61.
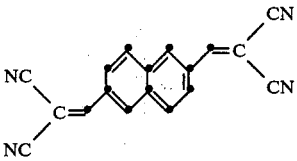
62.
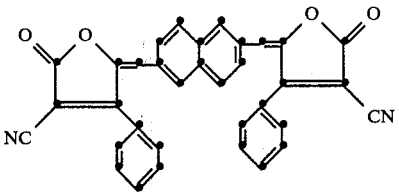
63.
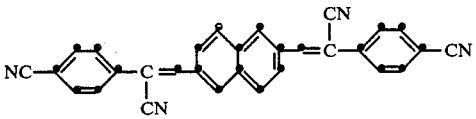

TABLE III-continued
Colorants
64.
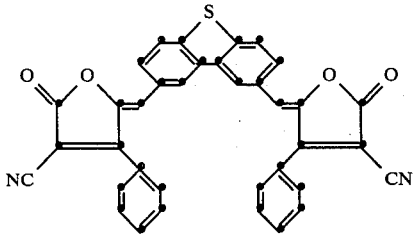
65.
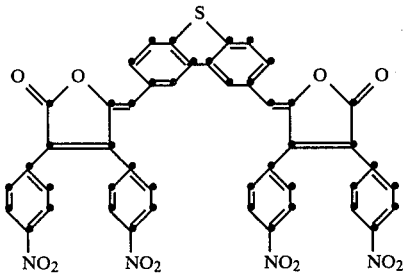
66.
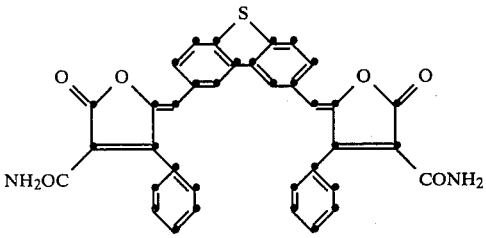
67.
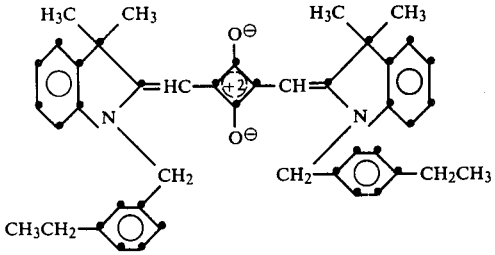
68.
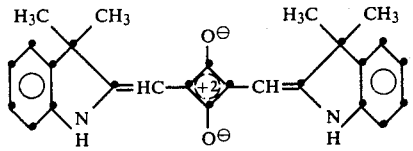
69.
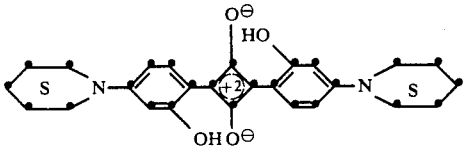
70.
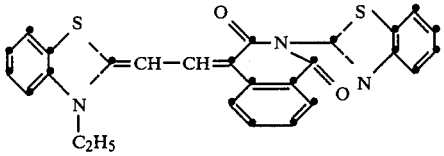
71.
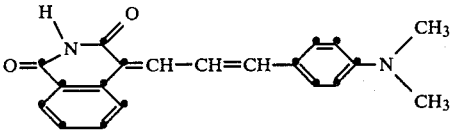
TABLE III-continued
Colorants
72.
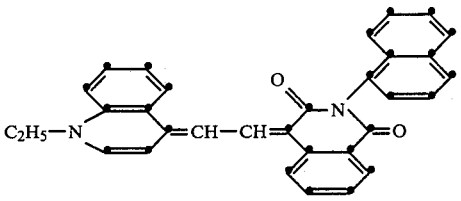
73.
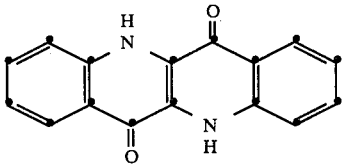
74.
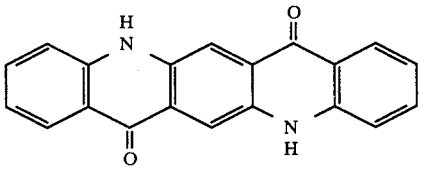
75.
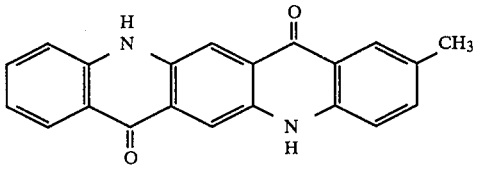
76.
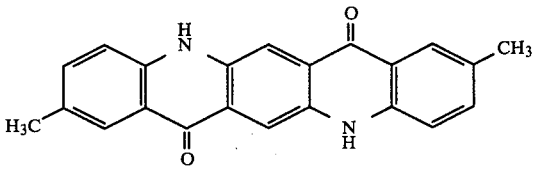
77.
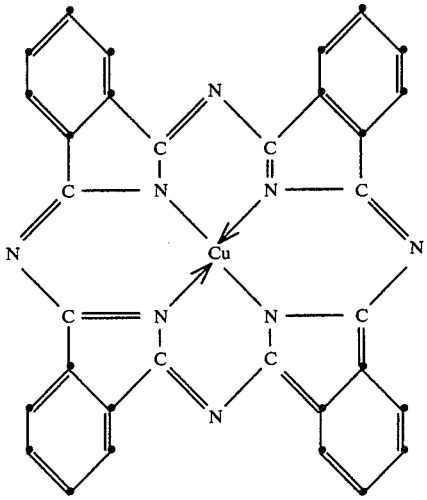

TABLE III-continued

| Colorants |
|---|
| 78. 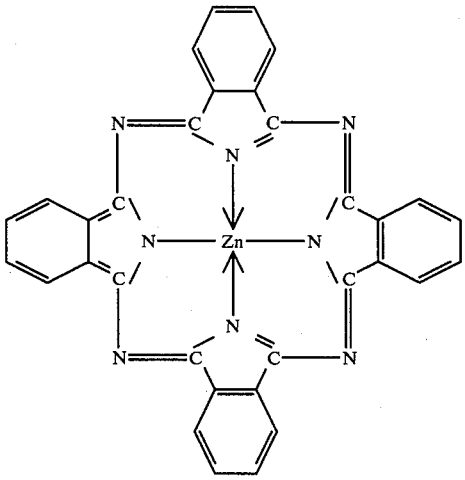 |

Color images resulting from the use of the electrically photosensitive composite particles of the present invention in migration imaging processes are improved when a colorless dye precursor is included in the composite particle. In this aspect of the invention, the electrode upon which the desired image is formed is coated with a receiving layer that contains a material that reacts with the colorless dye precursor to form a dye. Such reaction can be caused by, for example, treatment of the receiving layer with heat.

Other useful colorants are disclosed in the patents relating to electrophoretic migration imaging processes noted in the "Background of the Invention".

The following is a general procedure for the preparation of the electrically photosensitive particles of the invention and the migration imaging dispersions containing such particles.

Typically from about 10 to about 80 weight percent of the colorant is dispersed or ground with the dissolved polymeric binder in a liquid carrier to submicron particles on a ball mill, Dynomill ® (manufactured by Willy A. Bachofen Maschinenfabrik of Basil, Switzerland) or other milling device. The colorant/binder dispersion is added to a solvent in which the binder is insoluble, and the binder precipitates. In the case of the pigment, the binder precipitates out on the pigment surface. In the case of the dye, no milling is necessary and a solution of the binder and dye precipitates as a solid solution or a mixture of amorphous dye and polymer. The particles are isolated by centrifugation, filtration or diafiltration, and added to a carrier solvent containing a charge agent. The mixture is then dispersed.

An alternative method of making a composite particle is to either mill the colorant in the case of a pigment with a charge agent before addition of, or simultaneously with the selected binder, or to add some of the charge control agent after milling with the binder before precipitation.

Depending upon the solubility of a particular colorant in a particular binder, the colorant may be present in the electrically photosensitive particle as a dye in a solid solution with the binder or as a pigment dispersed in or intimately associated with the binder. Again, depending upon solubilities, the colorant may be present in the particle as a dye and a pigment. The colorant may also be present in the binder in an insoluble amorphous state. When the colorant is present as a dissolved or amorphous dye in the polymeric binder, images produced from the dispersion of such particles have higher optical densities and sharper absorption peaks as compared to composite particles containing the same pigments in an insoluble crystalline state.

The imaging dispersions can be prepared by admixing on a weight to weight basis, (a) about 1 to about 10 weight percent of electrically photosensitive composite particles, (b) about 1 to about 10 weight percent of a stabilizer or charge control agent, if desired, and (c) about 80 to about 98 weight percent of an electrically insulating carrier.

The electrically insulating carriers useful in forming the dispersions provided by the present invention may assume a variety of physical forms and can be selected from a variety of different materials. For example, the carrier material may be a matrix of an electrically insulating normally solid polymeric material capable of being softened of liquefied upon application of heat, solvent, and/or pressure so that the electrically photosensitive material dispersed therein can migrate through the carrier. The carrier may contain a polymeric solution such as Piccotex 100 (vinyltoluene-$\alpha$-methylstyrene copolymer) from Hercules Corporation in Solvesso 100 and/or Isopar G solvent from Exxon Corporation.

The carrier material can also comprise an electrically insulating liquid such as decane, paraffin, Sohio Odorless Solvent 3440 (a kerosene fraction marketed by the Standard Oil Company, Ohio), various isoparaffinic hydrocarbon liquids such as those sold under the trademark Isopar by Exxon Corporation, various alkylated aromatic hydrocarbon liquids such as the alkylated benzenes, for example, xylenes, and other alkylated aromatic hydrocarbons such as are described in U.S. Pat. No. 2,899,335.

An example of one such useful alkylated aromatic hydrocarbon liquid which is commercially available is Solvesso 100 made by Exxon Corp.

Typically, whether solid or liquid at normal room temperature of about 22° C., the electrically insulating carrier material used in the present invention is a material having a resistivity greater than about $10^9$ ohm-cms, preferably greater than about $10^{12}$ ohm-cm.

Various charge control agents or stabilizer materials may be added to the dispersions provided by the present invention to improve the uniformity of charge polarity of the electrically photosensitive material in liquid dispersions. These materials are typically polymeric materials incorporated by admixture thereof into the liquid carrier vehicle of the dispersion. In addition to, and possibly related to, the aforementioned enhancement of uniform charge polarity, it has been found that the charge control agents often provide more stable dispersions which exhibit substantially less settling out of the dispersed electrically photosensitive material.

Illustrative charge control agents include those disclosed in copending U.S. patent application Ser. No. 837,779 filed Sept. 29, 1977, by Stahly. The polymeric charge control agents disclosed therein comprise a copolymer having at least two different repeating units, (a) one of said units being present in an amount of at least about $0.5\times10^{-4}$ moles/gram of said copolymer and being derived from monomers selected from the group consisting of metal salts of sulfoalkyl acrylates and methacrylates and metal salts of acrylic and methacrylic acids, and (b) one of said repeating units being derived from monomers soluble in said carrier vehicle and present in an amount sufficient to render said copolymer soluble in said carrier vehicle.

Examples of such copolymer are poly(vinyltoluene-co-lauryl methacrylate-co-lithium methacrylate-co-methacrylic acid), poly(styrene-co-lauryl methacrylate-co-lithium sulfoethyl methacrylate), poly(vinyltoluene-co-lauryl methacrylate-co-lithium methacrylate), poly(t-butylstyrene-co-lauryl methacrylate-co-lithium methacrylate-co-methacrylic acid) or poly(t-butylstyrene-co-lithium methacrylate).

The process of the present invention will be described in more detail with reference to the accompanying drawing, FIGURE 1, which illustrates a typical apparatus upon which the electrophoretic migration imaging process of the invention is carried out.

FIGURE 1 shows a transparent electrode 10 supported by two rubber drive rollers 11 capable of imparting a translating motion via test target 12 to electrode 10 in the direction of the arrow. Electrode 10 may be composed of a layer of optically transparent material, such as a glass, or an electrically insulating, transparent polymeric support such as poly(ethylene terephthalate), covered with a thin, optically transparent, conductive layer such as tin oxide, indium oxide, nickel, and the like.

Spaced opposite electrode 10 and in pressure contact therewith is a second electrode 13, a roller which serves as a counter electrode to electrode 10 for producing the electric field used in the photoelectric migration imaging process. Typically, electrode 13 has on the surface thereof a thin, electrically insulating layer 22.

Electrode 13 is connected to one side of the power source 14 by switch 15. The opposite side of the power source 14 is connected to electrode 10 so that as an exposure takes place, switch 15 is closed and an electric field is applied to the photoelectrophoretic migration imaging dispersion 16 which is positioned between electrodes 10 and 13. The dispersion 16 may be positioned between electrodes 10 and 13 by applying dispersion 16 to either or both of the surfaces of electrode 10 and 13 prior to the imaging process or by injecting the dispersion 16 between electrodes 10 and 13 during the photoelectrophoretic migration imaging process.

As shown in FIGURE 1, exposure of dispersion 16 takes place by use of an exposure system consisting of light source 17, test target 12 to be reproduced, such as a photographic transparency, a lens system 18, and any necessary or desirable radiation filters 19, such as color filters, whereby dispersion 16 is irradiated with a pattern of activating radiation corresponding to test target 12.

Although the electrophoretic migration imaging device represented in FIGURE 1 shows electrode 10 to be transparent to activating radiation from light source 17, it is possible to irradiate electrically photosensitive particulate material 16 in the nip 20 between electrodes 10 and 13 without either electrodes 10 or 13 being transparent. In such a system, although not shown in FIGURE 1, the exposure source 17 and lens system 18 is arranged so that dispersion 16 is exposed in the nip or gap 20 between electrodes 10 and 13.

As shown in FIGURE 1, electrode 13 is a roller electrode having a conductive core 21 connected to power source 14. The core is in turn covered with a layer of insulating material 22, for example, baryta paper with a Butvar overcoat. Insulating material 22 serves to prevent or at least substantially reduce the capability of the electrically photosensitive pigments in dispersion 16 to undergo a radiation-induced charge alteration upon interaction with electrode 13.

Although electrode 13 is shown as a roller electrode and electrode 10 is shown as essentially a translatable, flat plate electrode in FIGURE 1, either of both of these electrodes may assume a variety of different shapes such as a web electrode, rotating drum electrode, plate electrode, and the like, as is well known in the field of electrophoretic migration imaging.

In general, during a typical photoelectrophoretic migration imaging process wherein dispersion 16 comprises an electrically insulating liquid carrier, electrodes 10 and 13 are spaced such that they are in pressure contact or very close to one another during the electrophoretic migration imaging process. Typical separation between electrodes is 1–50$\mu$.

The strength of the electric field imposed between electrodes 10 and 13 during the photoelectrophoretic migration imaging process of the present invention may vary considerably. However, it has generally been found that optimum image density and resolution are obtained by increasing the field strength to as high a level as possible without causing electrical breakdown within the system.

As explained hereinabove, image formation occurs in electrophoretic migration imaging processes as the result of the combined action of activating radiation and electric field on the electrically photosensitive particulate material 16 disposed between electrodes 10 and 13. Typically, for best results, field application and exposure to activating radiation occur concurrently. However, as would be expected, by appropriate selection of various process parameters such as field strength, activating radiation intensity, incorporation of suitable light-sensitive addenda in or together with the electrically photosensitive particles used in the present invention, it is possible to alter the timing of the field and exposure application events so that one may use sequential exposure and field application events rather than concurrent field application and exposure events.

Subsequent to the application of the electric field and exposure to activating radiation, the images which are formed on the surface of electrodes 10 and/or 13 of the apparatus shown in FIGURE 1 may be temporarily or permanently fixed to these electrodes or may be transferred to a final image-receiving element.

Fixing of the final particle image can be effected by various techniques, for example, by applying a resinous coating over the surface of the image-bearing substrate. For example, if electrically photosensitive particles 16 are dispersed in a liquid carrier between electrodes 10 and 13, one may fix the image or images formed on the surface of electrodes 10 and/or 13 by incorporating a polymeric binder material in the carrier liquid. Many such binders (which are well known for use in liquid electrophotographic liquid developers) are known to acquire a charge polarity upon being admixed in a carrier liquid and therefore will, themselves, electrophoretically migrate to the surface of one or the other of the electrodes. Alternatively, a coating of a resinous binder (which has been admixed in the carrier liquid) may be formed on the surfaces of electrodes 10 and/or 13 upon evaporation of the liquid carrier. Or, if enough polymer of correct glass transition temperature is present, particles can be heat- and/or pressure-fixed without additional polymers. Here again, the use of such fixing addenda is conventional and well known in the closely related art of liquid electrographic developer compositions so that extended discussion thereof is unnecessary herein.

The electrically photosensitive composite particles of the present invention may be used to form monochrome images or they may be admixed with other electrically photosensitive material of proper color and photosensitivity to form polychrome dispersions for use in making polychrome images. Polychrome images may also be formed from admixtures made up solely of the composite particles of the present invention. Such a dispersion may contain cyan, yellow and magenta composite particles of the present invention. When such a polychrome dispersion of multicolored, electrically photosensitive composite particles is formed, for example, in an electrically insulating carrier liquid, this liquid mixture of particles exhibits a black coloration. Preferably, the specific cyan, magenta, and yellow pigments selected for use in said composite particles are chosen so that their spectral response curves do not appreciably overlap whereby color separation and subtractive multicolor image reproduction can be achieved in polychrome imaging. As stated hereinbefore, such polychrome dispersions are selectively sensitized when composite particles of the present invention are included therein.

The following examples illustrate the invention, the parts and percentages being by weight unless otherwise stated.

EXAMPLES

Image Evaluation Apparatus

An image evaluation apparatus was used in each of the succeeding examples to carry out the electrophoretic migration imaging process described herein. This apparatus was a device of the type illustrated in FIGURE 1. In this apparatus, a translating NESA or NESATRON (trademarks of PPG for a conductive tin oxide treated glass or a conductive indium oxide sputtered glass, respectively) glass plate served as electrode 10 and was in pressure contact with a 10 centimeter diameter metal roller 21 covered with, for example, resin) purchased under the tradename Butvar-B-76 from Monsanto Chemical Corp. or a cellulose acetate —$TiO_2$— Estane electrode from B. F. Goodrich Co.

NESA plate 10 was supported by two 2.8 cm. diameter rubber drive rollers 11 positioned beneath NESA plate 10 such that a 2.5 cm. opening, symmetric with the axis of the aluminum roller 21, existed to allow exposure of electrically photosensitive particle dispersion 16 to activating radiation. The original transparency 12 to be reproduced was taped to the back side of NESA plate 10. The exposing activating radiation was supplied from a light source 17 consisting of a Kodak Carousel projector and had a maximum intensity of 3500 foot candles at the NESA glass plate exposure plane. The voltage between the electrode 13 and NESA plate 10 was variable up to 10 kilovolts. However, most tests were made in the 0.4 to 2 KV range. NESA plate 10 was negative in polarity. The translational speed of NESA plate 10 was variable between about 1.25 cm. and about 30 cm. per second. In the following examples, image formation occurs on the surfaces of NESA glass plate 10 and electrode 13 after simultaneous application of light exposure and electric field to electrically photosensitive dispersion 16. In this image-evaluation apparatus, each different particle to be evaluated for use as a composite electrically photosensitive dispersion 16 was admixed with a liquid carrier as described in the examples to form a liquid imaging dispersion which was placed in nip 20 between the electrodes 10 and 13. If the material being evaluated for use as dispersion 16 possessed a useful level of electrical photosensitivity, one obtained a negative-appearing image reproduction of original 12 on electrode 13 and the complementary positive image on electrode 10.

EXAMPLE 1

Colorants 1–29 of Table III were used to form 28 different composite electrically photosensitive particles. Separate imaging dispersions were prepared with each particle as follows.

A solution of 0.045 g of a colorant from Table III in 20.0 g methylene chloride was prepared. Poly(di-p-tolylaminostyrene) binder (0.255 g) was added to the solution. When the polymer was completely dissolved, the solution was added to 225 ml Isopar G with rapid stirring. The resultant precipitate, containing 15 percent of the dye, was isolated by centrifugation and allowed to partially air dry overnight.

The imaging dispersions was prepared by combining 0.26 g of the above Isopar-moist precipitate with a solution of 0.26 g poly(vinyltoluene-co-lauryl-methyacrylate-co-lithium methacrylate-co-methacrylic acid) (PVT) as stabilizer in 4.65 g Isopar G and 12 g of 0.318 cm type 440 stainless-steel balls. This mixture was milled for 3 hours on a Red Devil® paint conditioner before imaging.

The dispersions were imaged with an imaging apparatus of the type previously described. The apparatus was equipped with a xenon (Optical Radiation Co.) or a Carousel projector equipped with a tungsten light source (Eastman Kodak Co.) which was filtered with a W2C Wratten filter made by Eastman Kodak Co. to remove UV light and a wide-band hot mirror filter from OCLI (Optical Coating Laboratory, Inc.) to remove infrared light. The speed of the imaging electrode was 12.5–50 cm/sec. A voltage of −1.5 kV was applied to the imaging electrode. The test target or original consisted of Wratten Filter Numbers W0, W29, W99 and W47B (representing clear, red, green and blue exposures), superimposed on a 0.3 neutral density carbon step tablet.

Each colorant/polymer combination was determined to be electrically photosensitive in that complementary images were formed on each electrode of the imaging apparatus.

EXAMPLE 2

An image was formed with Colorant 8 of Table III, according to the above procedure, except that a polymeric binder according to the present invention was omitted. The procedure of Example 1 was otherwise followed in dispersion preparation. However, the density and speed of the image were inferior to the image obtained using Colorant 8 in Example 1. (See Table III A.)

TABLE III A

| Colorant | Binder | Dmax | Dmin | Relative Sensitivity |
|---|---|---|---|---|
| Colorant 8 (Control) | No Binder | 0.54 | 0.15 | 100* |

TABLE III A-continued

| Colorant | Binder | Dmax | Dmin | Relative Sensitivity |
|---|---|---|---|---|
| Colorant 8 | Ex. 1 Binder | 1.42 | 0.08 | 2756 |

*Control is arbitrarily assigned a value of 100.

Relative sensitivity is a relative reciprocal measurement of exposure (when measured in ergs/cm$^2$). Relative sensitivity is calculated according to the following formula:

$$Rn=(An)(Ro/Ao)$$

wherein

Rn is the relative sensitivity of a given photoelectrophoretic imaging particle n.

An is the reciprocal of the absolute electrical exposure (when measured in ergs/cm$^2$) of imaging particle n.

Ro is the sensitivity value arbitrarily assigned to the control imaging particle.

Ao is the reciprocal of the absolute electrical exposure (when measured in ergs/cm$^2$) of the control imaging particle.

The hue of the image formed from Colorant 8 alone was desaturated relative to that of the image formed with the composite particle which included Colorant 8 in Example 1.

EXAMPLE 3

Colorants 1 and 15 of Table III were separately dispersed (45 mg each) in a solution of Piccotex 100 (1.4 g) and PVT (0.1 g) in Isopar G (2.2 g) and Solvesso 100 (1.3 g) and imaged as in Example 1. No polymer was included. Colorant 1 gave no image. Colorant 15 gave an image of comparable speed in this case to those particles formed with colorant 15 in Example 1. However, the latter image was much lower in density than the comparable Example 1 image.

EXAMPLE 4

Cyan, magenta and yellow composite particle dispersions were prepared as in Example 1. The dispersions consisted of 10% colorant and 90% poly[4-(di-p-tolylamino) styrene-co-vinyltoluene-co-lauryl methacrylate-co-acrylic acid] 60:20:16:4. The cyan colorant was colorant 25 of Table III; the magenta was colorant 24 of Table III; and yellow was colorant 15 of Table III. Equal parts by weight of the three dispersions were combined and mixed briefly by shaking. An image was then produced as previously described in Example 1 using the same test target. Very good color separation, low Dmin and high sensitivity were observed.

EXAMPLE 5

Cyan Blue GTNF (American Cyanamid) pigment particles were ball milled for 4 days with PVT using 57 gm of 3.2 mm stainless-steel balls and at a pigment:-stabilizer ratio of 1:1 in dichloromethane. The formulation was:

| | |
|---|---|
| Cyan Blue GTNF | 3 gm |
| PVT (Stabilizer) | 3 gm |
| dichloromethane | 40 ml |

The above milled dispersion was combined with a solution containing 3 gm of binder polymer, poly[4-(diphenylamino)styrene] and 40 ml dichloromethane. This mixture was milled overnight. The composite particles were formed by precipitating the dispersion in 800 ml of Isopar G. The composite particles were centrifuged, resuspended in 300 ml of Isopar G, and isolated by filtration as a wet cake.

A cyan imaging dispersion at 2% pigment concentration was prepared by ball-milling the following formulation for 1 hour in a 60 ml glass vial with 33 gm of 3.2 mm stainless-steel balls. Dispersion components were as follows:

| | |
|---|---|
| Cyan pigment-binder composite particles (from wet cake above) | 1.07 gm of wet cake |
| Stabilizer polymer (PVT) in Isopar G solution 1 gm PVT/12.25 g Isopar G | 2.45 gm of solution |
| Isopar G | 6.5 gm |

The cyan imaging dispersion (A) was imaged on an imaging apparatus of the type shown in FIGURE 1 except that the bias on the plate electrode was −1000 V. The plate speed was 25 cm. per second. The exposure was through a Kodak No. 5 flexible M-carbon step tablet with 0.3 neutral density increments at 3000 foot candles. The width of exposure was 8 mm at the exposure plane.

The resultant image was of excellent quality with Dmax/Dmin (measured as reflection densities of the positive image) being 1.20/0.12.

EXAMPLE 6

A second cyan imaging dispersion was prepared according to the method described in Example 5 with the exception that poly(ethyl methacrylate-co-methyl methacrylate-co-lauryl methacrylate-co-lithium sulfoethyl methacrylate) 50:22:16:12 was used as the binder instead of a polymer according to this invention. The binder polymer used in this example is similar to polymers suggested for use in the prior art for forming liquid electrographic developers, e.g., U.S. Pat. No. 3,788,995. The composition of the dispersion was:

| | |
|---|---|
| Cyan Pigment-binder composite particles | 1.87 gm of wet cake |
| PVT in Isopar G solution (stabilizer) | 6.13 gm of solution |
| Isopar G | 17.00 gm |

Imaging conditions were similar to those described in Example 5. The image quality was poor and had a Dmax of only 0.18 and a Dmin of 0.03 (measured as reflection densities of the positive image).

EXAMPLE 7

A control dispersion was prepared by milling a pigment with PVT and Solvesso 100 for 7 days. The pigment particles were then added to a solution of Piccotex 100 polymer in Isopar G and milled for 28 days.

The dispersion components were on a weight basis as follows:

| | |
|---|---|
| Cyan Blue GTNF | 2% |
| PVT | 2% |
| Isopar G | 43% |
| Solvesso 100 | 24% |
| Piccotex 100 | 29% |

-continued

| Milling Time | 28 days |
|---|---|

The speed of the control was compared with the speed of the cyan imaging dispersions of Examples 5 and 6. The speeds were determined from the reflection density of the positive image versus Log Exposure curves. The curves were plotted based on measurements obtained on a MacBeth RD-400 reflection densitometer with a status D red filter. The speed was determined at the speed point at 0.2 above Dmin.

TABLE IV

| Dispersion | Binder | Relative Sensitivity |
|---|---|---|
| Example 5 | Binder of Invention | 135 |
| Example 6 | Prior Art Binder | * |
| Example 7 (Control) | Pigment - No Binder | 100** |

*Speed points could not be determined at 0.2 above Dmin. Dmax is very low.
**Control is arbitrarily assigned a value of 100.

EXAMPLES 8–10

Three separate cyan imaging dispersions were prepared as in Example 5. Each dispersion contained a different set of composite particles. The same cyan pigment was used in each set of particles. The polymers of this invention were poly[4-(phenothiazinyl)styrene] (Example 8); poly[4-di-p-tolylamino)styrene] (Example 9) and poly[4-(dibenzylamino)styrene] (Example 10).

Each dispersion was tested in a traveling plate migration imaging apparatus of the type described in FIG. 1 except that the applied voltage was −1250 volts. Exposures were made with an action zone of 15 mm. Photographic sensitivities were measured as in Example 7 and are compared in Table V.

TABLE V

| Example No. | Relative Sensitivity |
|---|---|
| Control from Example 7 | 100* |
| 8 | 114 |
| 9 | 275 |
| 10 | 189 |

*Control is arbitrarily assigned a value of 100.

The following example illustrates the selective sensitization capability which the present invention provides.

EXAMPLE 11

Separate cyan, magenta and yellow control dispersions were prepared with colorants without binders according to the invention. The colorant of each dispersion was ball-milled with a 5% PVT in dichloromethane for 3–8 days with 3.2 mm stainless-steel balls. The volume of this dispersion was then increased by a factor of 10 with Isopar G. The resultant dispersion was centrifuged and the particles redispersed in 8% PVT/Isopar G solution on a paint shaker containing stainless-steel balls for 30 minutes. The colorants used were Cyan Blue GTNF (Cyan); mixed quinacridone consisting of a crystalline mixture of quinacridone, 2-methyl quinacridone, and 2,9-dimethyl quinacridone (Magenta) and epindolidione (Yellow).

A second set of three dispersions was prepared according to the present invention. Each contained a different set of colorant binder composite particles. The cyan, magenta and yellow colorants as described above were each prepared separately with poly[4-(di-p-tolylamino)styrene] as the binder. The colorant:binder ratio in each composite particle was 1:0.5.

Ten grams of colorant (8%) and 5 grams of the binder polymer (4%) were milled in the batch chamber (0.15 l) of a Dynomill ® in dichloromethane with 0.5–0.75 mm glass beads at 3000 rpm for 15 mins. The concentrate was filtered from the beads. The beads were rinsed with a small amount of dichloromethane. The rinse and concentrate were combined and stirred together.

The above dispersion was poured rapidly into a large volume of mechanically stirred Isopar G. The precipitated colorant polymeric binder particles were isolated by centrifugation. The particles were redispersed on a paint shaker with a solution of PVT in Isopar G at a pigment:PVT weight ratio of 1:1.

Trimix dispersions of the above composite particle dispersions were prepared by mixing the three different colored dispersions in equal amounts and adjusting the color of a streak of the trimix on white paper until neutral to the eye by the addition of small amounts of the trimix dispersion components. Imaging and sensitometric measurements were carried out for each dispersion substantially according to Example 7. Speed points were calculated at 0.2 above Dmin. and are compared in Table VI as relative sensitivities.

TABLE VI

| Trimix | Pigment | Binder | Relative Sensitivity |
|---|---|---|---|
| 1 | Cyan | No | 100* |
| | Magenta | No | 100* |
| | Yellow | No | 100* |
| 2 | Cyan | Yes | 4180 |
| | Magenta | Yes | 1022 |
| | Yellow | Yes | 361 |
| 3 | Cyan | No | 110 |
| | Magenta | Yes | 937 |
| | Yellow | Yes | 370 |

*Each control colorant is arbitrarily assigned a value of 100. Speeds of corresponding colorant binder composite particles in other trimixes are relative to the control colorants.

The data of Table VI shows that the composite particles of the invention have greatly enhanced sensitivity compared with the control colorants. The cyan colorants in trimixes 1 and 3 are not associated with a binder of the invention. The cyan colorants in both trimixes have similar sensitivities even though the cyan colorant in trimix 3 is surrounded by yellow and magenta composite particles of the invention. This is evidence that the polymeric binders of the invention do not adversely affect the electrical photosensitivity of other electrically photosensitive colorants with which they are not intimately associated.

The following example illustrates the invention when a colorless dye precursor is included in the composite particle.

EXAMPLE 12

Poly[4,4'-bis(N-ethyl-N-ethyleneamino)-2,2'-dimethyltriphenylmethane carbonate] (0.20 g) and 0.10 g leuco dye, 2,3,5-triphenyl-2H-tetrazolium chloride (dye precursor) were dissolved in 4.5 g dichloromethane. To this solution was added 0.20 g Cyan Blue GTNF and 0.05 g of poly(di-p-tolylaminostyrene) in 4.25 g dichloromethane. This mixture was added in a thin stream to a stirred 400 ml beaker containing 90 g Isopar G. An amount of 3.1 g of 8% PVT in Isopar G solution was added and the entire mixture was transferred to a rotary evaporator. The dispersion was concentrated to 12.5 g, a 4 g aliquot was transferred to a 2 dram vial, 12 g of stainless-steel balls were added and the mixture was agitated on a paint shaker for 20 minutes.

An image was formed as in Example 1, except that electrode 22 was cellulose acetate —$TiO_2$— Estane overcoated with a solution of 0.25 g poly(ethylene terephthalate-co-1,4-cyclohexanedimethylene terephthalate) and 0.25 g 2,5-disec-dodecylhydroquinone in 11 g dichloromethane with a 3 mil coating knife. The applied voltage was −1 KV and plate velocity was 25.4 cm/sec.

The image was heated to 140° C., forming a good red formazan dye image.

The invention has been described in detail with particular reference to certain preferred embodiments thereof, but it will be understood that variations and modifications can be effected within the spirit and scope of the invention.

We claim:

1. An electrophoretic migration imaging dispersion comprising an electrically insulating carrier, and a plurality of electrically photosensitive particles wherein at least a portion of said electrically photosensitive particles is a composite particle comprising a colorant and a polymeric binder comprising repeating units containing one or more structures selected from the classes consisting of triarylamines; p-aminotetraarylmethane;s 4,4'-bis(p-amino)triarylmethanes; 1,1-bis(p-aminoaryl)isobutanes; 1,1-bis(p-aminoaryl)cyclohexanes; N-alkyl-N,N-diarylamines; N,N-dialkyl-N-arylamines and heterocyclic nitrogen compounds having about 4 to 10 carbon atoms.

2. An electrophoretic migration imaging dispersion comprising an electrically insulating carrier, and a plurality of electrically photosensitive particles wherein at least a portion of said electrically photosensitive particles is a composite particle comprising a colorant and a polymeric binder comprising repeating units containing one or more structures selected from the group consisting of:

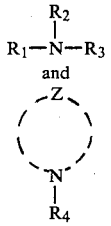

I.

II.

wherein:

$R_1$ represents a substituted or unsubstituted aryl;

$R_2$ and $R_3$, which are the same or different, represent oxyalkyl, carboxyalkyl, alkyl, hydroxyalkyl, styrylcarbonyl, alkenyl, benzyl, or substituted or unsubstituted aryl;

$R_4$ represents hydrogen, alkyl of about 1–4 carbon atoms, vinylaryl, substituted or unsubstituted aryl or a covalent bond to an adjacent ring carbon atom;

Z represents sufficient atoms to form a substituted or unsubstituted alkylene chain of about 4 to 10 carbon atoms or a substituted or unsubstituted heterocyclic ring selected from the group consisting of pyrazoline, pyrrole, imidazole, isoindole, 9,9'-bijulolidine, phenothiazine, julolidine, 3,3'-bipyrazoline or piperidine;

said substituents on said alkylene chain being selected from the group consisting of hydrogen, oxo, carboxy, alkyl, acyl, alkenyl, hydroxy and substituted or unsubstituted aryl;

said substituents on said substituted aryl are selected from the group consisting of styrylvinyl, alkylcarboxyalkyl, hydroxyalkyl, alkoxy, vinyl, alkyl, alkoxycarbonyl, carboxyalkyl, triarylalkyl, benzoylalkenyl, carboxyalkenyl, 5-styryl-2-furanylalkenyl, 2-furanylalkenyl, p-(N-ethyl-N-tolylamino)arylazo, p-alkylarylazo, carboxy, 2-quinolinylalkenyl 6-alkyl-4-oxo-4(H)-2-pyranylalkenyl, arlalkanediyl, alkanetriyl, cycloalkanediyl, isoalkanediyl, oxoalkenediyl, diarylalkylene, alkanetetrayl, arylalkanediyl, styryl, cyano, halo, alkylcarbonyl, oxoalkyl, isoalkyl, benzyl, oximidoalkyl, semicarbazonoalkyl, aryloxoalkenyl, cycloalkyl, p-N,N-dialkylaminoarylazo and condensed aryl; and said substituents on said heterocyclic ring are the same as $R_4$ above.

3. An electrophoretic migration imaging dispersion comprising an electrically insulating carrier and a plurality of electrically photosensitive particles wherein at least a portion of said particles is a composite particle comprising a colorant and a polymeric binder comprising repeating units containing one or more structures selected from the group consisting of:

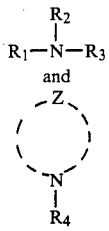

III.

IV.

wherein:

$R_1$ represents a substituted or unsubstituted member selected from the group consisting of phenyl and naphthyl;

$R_2$ and $R_3$, which are the same or different, represent methyl, ethyl, hydroxyethyl, carboxyethyl, benzyl, or substituted or unsubstituted phenyl;

$R_4$ represents a covalent bond to an adjacent ring carbon atom or a substituted or unsubstituted phenyl;

Z represents sufficient atoms to form a substituted or unsubstituted alkylene chain of about 4 to 10 carbon atoms or a substituted or unsubstituted heterocyclic ring selected from the group consisting of pyrrole; 9,9'-bijulolidine, phenathiozine, julolidine, and pyrazoline;

said substituents on the phenyl or naphthyl are selected from the group consisting of methyl, ethyl, isobutyl, benzyl, carboxyethyl, cyclohexyl, vinyl, diphenylethyl, triphenylmethyl, hydroxyethyl, p-(N-ethyl-N-tolylamino)phenylazo, 2-quinolinylethenyl, 6-methyl-4-oxo-4(H)-2-pyranylethenyl, and methoxy;

said substituents on the alkylene chain are selected from the group consisting of oxo, carboxy, acyl, cyano and hydroxy; and said substituents on the heterocyclic ring are the same as $R_4$ above.

4. An electrophoretic migration imaging dispersion comprising an electrically insulating carrier and a plurality of electrically photosensitive particles wherein at least a portion of said particles is a composite particle comprising a colorant and a polymeric binder comprising repeating units containing one or more structures selected from the group consisting of 4-di-p-tolylaminostyrene; 4,4'-bis(diethylamino)-2,2'-dimethyltriphenylmethane; 1,1-bis(4-N,N-diethylamino-2-methylphenyl)isobutane; triphenylamine; 4-diethylaminotetraphenylmethane; 1,1-bis(4-N,N-diethylaminophenyl)cyclohexane; 1,1-bis(4-N-methyl-N-phenylaminophenyl)isobutane; 1,1-bis(4-N-methyl-N-phenylaminophenyl)-ethane; 1,1-bis(4-N,N-diethylamino-2-methylphenyl)-1-phenylethane and tri-p-tolylamine.

5. A photoelectrophoretic migration imaging dispersion comprising an electrically insulating carrier and a plurality of electrically photosensitive particles wherein at least a portion of said particles is a composite particle comprising a colorant and a polymeric binder selected from the group consisting of poly[4-(di-p-tolylamino)styrene], poly[4-(di-p-anisylamino)styrene], poly[4-di-p-tolylaminostyrene-co-lauryl methacrylate], poly[4-di-p-tolylaminostyrene-co-lauryl methacrylate-co-lithium methacrylate-co-methacrylic acid], poly[4-di-p-tolylaminostyrene-co-lauryl methacrylate-co-acrylic acid], poly[4,4'-bis(N-ethyl-N-ethyleneamino)-2,2'-dimethyltriphenylmethane ditolylaminobenzylmalonate], poly[4,4'-bis(N-ethyl-N-ethyleneamino)-2,2'-dimethyl-4''-methoxytriphenylmethane carbonate], poly[4-di-p-tolylaminostyrene-co-p-methylstyrene-co-lauryl methacrylate-co-acrylic acid], poly[4,4'-bis(N-ethyl-N-ethyleneamino)-2,2'-dimethyltriphenylmethane terephthalate], poly[4,4'-bis(N-ethyl-N-ethyleneamino)-2,2'-dimethyltriphenylmethane-1,4-cyclohexanedicarboxylate], poly[bis(4-N,N-diethylamino-2-methylphenyl)methyl-p-phenoxyethyl methacrylate], poly[1,1-bis(4-[N-ethyl-N-ethyleneamino]-2-methylphenyl-)isobutylidene terephthalate], poly[4-di-p-tolylaminostyrene-co-lauryl methacrylate-co-lithium acrylate], and poly[4-di-p-tolylaminostyrene-co-lauryl methacrylate-co-acrylic acid-co-lithium acrylate].

6. A dispersion as in claims 1, 2, 3, 4 or 5, wherein said colorant is electrically photosensitive.

7. A dispersion as in claims 1, 2, 3, 4 or 5, wherein said colorant is an electrically photosensitive material selected from the group consisting of:

(a) aromatic vinyl compounds having condensed heterocyclic nitrogen-containing nucleus;
(b) aromatic vinyl arylamine compounds;
(c) aromatic vinyl compounds having a heterocyclic nucleus;
(d) merocyanine and benzylidenes having at least one nucleus selected from the group consisting of pyran, thiopyran, selenopyran, 1,4-dihydroxypyridine, isoxazolone, malononitrile, cyanomethylene, barbituric acid, thiobarbituric acid, quinolinediones and isoquinolinediones;
(e) allopolar compounds;
(f) cyclobutenylium compounds; and
(g) aryl-substituted vinyl compounds.

8. A dispersion as in claims 1, 2, 3, 4 or 5, wherein said colorant is an electrically photosensitive material selected from the group consisting of mixed quinacridone, epindolidione and copper phthalocyanine.

9. A dispersion as in claims 1, 2, 3, 4 or 5 wherein said colorant is selected from the group consisting of pyrylium, thiopyrylium, acridinium, pyridinium, rhodamine, merocyanine and cyanine dyes.

10. A dispersion as in claims 1, 2, 3, 4 or 5 wherein said dispersion also includes a charge control agent.

11. In an electrophoretic migration imaging process which comprises (a) subjecting an electrophoretic migration imaging dispersion comprising an electrically insulating carrier, and a plurality of electrically photosensitive particles positioned between at least two electrodes to an applied electric field, and
(b) exposing said dispersion to an image pattern of radiation to which said particles are photosensitive, thereby obtaining image formation on at least one of said electrodes, the improvement wherein at least a portion of said electrically photosensitive particles is a composite particle comprising a colorant and a polymeric binder comprising repeating units containing one or more structures selected from the classes consisting of triarylamines; p-aminotetraarylmethanes; 4,4'-bis(p-amino)-triarylmethanes; 1,1-bis-(p-aminoaryl)isobutanes; 1,1-bis(p-aminoaryl)cyclohexanes; N-alkyl-N,N-diarylamines; N,N-dialkyl-N-arylamines and heterocyclic nitrogen compounds having about 4 to 10 carbon atoms.

12. In an electrophoretic migration imaging process which comprises (a) subjecting an electrophoretic migration imaging dispersion comprising an electrically insulating carrier, and a plurality of electrically photosensitive particles positioned between at least two electrodes to an applied electric field, and
(b) exposing said dispersion to an image pattern of radiation to which said particles are photosensitive, thereby obtaining image formation on at least one of said electrodes, the improvement wherein at least a portion of said electrically photosensitive particles is a composite particle comprising a polymeric binder which comprises repeating units containing one or more structures selected from the group consisting of:

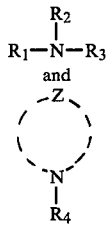

I.

II.

wherein:

$R_1$ represents a substituted or unsubstituted aryl;
$R_2$ and $R_3$, which are the same or different, represent oxyalkyl, carboxyalkyl, alkyl, hydroxyalkyl, styrylcarbonyl, alkenyl, benzyl, or substituted or unsubstituted aryl;
$R_4$ represents hydrogen, alkyl of about 1–4 carbon atoms, vinylaryl, substituted or unsubstituted aryl or a covalent bond to an adjacent ring carbon atom;
Z represents sufficient atoms to form a substituted or unsubstituted alkylene chain of about 4 to 10 carbon atoms or a substituted or unsubstituted heterocyclic ring selected from the group consisting of pyrazoline, pyrrole, imidazole, isoindole, 9,9'-bijulolidine, phenothiazine, julolidine, 3,3'-bipyrazoline or piperidine;

said substituents on said alkylene chain being selected from the group consisting of hydrogen, oxo, carboxy, alkyl, acyl, alkenyl, hydroxy and substituted or unsubstituted aryl;

said substituents on said substituted aryl are selected from the group consisting of styrylvinyl, alkylcarboxyalkyl, hydroxyalkyl, alkoxy, vinyl, alkyl, alkoxycarbonyl, carboxyalkyl, triarylalkyl, benzoylalkenyl, carboxyalkenyl, 5-styryl-2-furanylalkenyl, 2-furanylalkenyl, p-(N-ethyl-N-tolylamino)arylazo, p-alkylarylazo, carboxy, 2-quinolinylalkenyl 6-alkyl-4-oxo-4(H)-2-pyranylalkenyl, arylalkanediyl, alkanetriyl, cycloalkanediyl, isoalkanediyl, oxoalkenediyl, diarylalkylene, alkanetetrayl, arylalkanediyl, styryl, cyano, halo, alkylcarbonyl, oxoalkyl, isoalkyl, benzyl, oximidoalkyl, semicarbazonoalkyl, aryloxoalkenyl, cycloalkyl, p-N,N-dialkylaminoarylazo and condensed aryl; and said substituents on said heterocyclic ring are the same as $R_4$ above.

13. In an electrophoretic migration imaging process which comprises (a) subjecting an electrophoretic migration imaging dispersion comprising an electrically insulating carrier, and a plurality of electrically photosensitive particles positioned between at least two electrodes to an applied electric field, and (b) exposing said dispersion to an image pattern of radiation to which said particles are photosensitive, thereby obtaining image formation on at least one of said electrodes, the improvement wherein at least a portion of said electrically photosensitive particles is a composite particle comprising a colorant and a polymeric binder comprising repeating units containing one or more structures selected from the group consisting of:

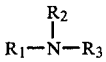
III.

and

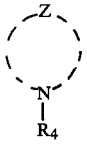
IV.

wherein:

$R_1$ represents a substituted or unsubstituted member selected from the group consisting of phenyl and naphthyl;

$R_2$ and $R_3$, which are the same or different, represent methyl, ethyl, hydroxyethyl, carboxyethyl, benzyl, or substituted or unsubstituted phenyl;

$R_4$ represents a covalent bond to an adjacent ring carbon atom or a substituted or unsubstituted phenyl;

Z represents sufficient atoms to form a substituted or unsubstituted alkylene chain of about 4 to 10 carbon atoms or a substituted or unsubstituted heterocyclic ring selected from the group consisting of pyrrole; 9,9'-bijulolidine, phenathiozine, julolidine, and pyrazoline;

said substituents on the phenyl or naphthyl are selected from the group consisting of methyl, ethyl, isobutyl, benzyl, carboxyethyl, cyclohexyl, vinyl, diphenylethyl, triphenylmethyl, hydroxyethyl, p-(N-ethyl-N-tolylamino)phenylazo, 2-quinolinylethenyl, 6-methyl-4-oxo-4(H)-2-pyranylethenyl and methoxy;

said substituents on the alkylene chain are selected from the group consisting of oxo, carboxy, acyl, cyano and hydroxy; and said substituents on the heterocyclic ring are the same as $R_4$ above.

14. In an electrophoretic migration imaging process which comprises (a) subjecting an electrophoretic migration imaging dispersion comprising an electrically insulating carrier, and a plurality of electrically photosensitive particles positioned between at least two electrodes to an applied electric field, and (b) exposing said dispersion to an image pattern of radiation to which said particles are photosensitive, thereby obtaining image formation on at least one of said electrodes, the improvement wherein at least a portion of said electrically photosensitive particles is a composite particle comprising a colorant and a polymeric binder comprising repeating units containing one or more structures selected from the group consisting of 4-di-p-tolylaminostyrene; 4,4'-bis(diethylamino)-2,2'-dimethyltriphenylmethane; 1,1-bis(4-N,N-diethylamino-2-methylphenyl)isobutane; triphenylamine; 4-diethylaminotetraphenylmethane; 1,1-bis-(4-N,N-diethylaminophenyl)cyclohexane; 1,1-bis(4-N-methyl-N-phenylaminophenyl)isobutane; 1,1-bis(4-N-methyl-N-phenylaminophenyl)ethane; 1,1-bis(4-N,N-diethylamino-2-methylphenyl)-1-phenylethane and tri-p-tolylamine.

15. In an electrophoretic migration imaging process which comprises (a) subjecting an electrophoretic migration imaging dispersion comprising an electrically insulating carrier, and a plurality of electrically photosensitive particles positioned between at least two electrodes to an applied electric field, and (b) exposing said dispersion to an image pattern of radiation to which said particles are photosensitive, thereby obtaining image formation on at least one of said electrodes, the improvement wherein at least a portion of said electrically photosensitive particles is a composite particle comprising a colorant and a polymeric binder selected from the group consisting of poly[4-(di-p-tolylamino)styrene], poly[4-(di-p-anisylamino)styrene], poly[4-di-p-tolylaminostyrene-co-lauryl methacrylate], poly[4-di-p-tolylaminostyrene-co-lauryl methacrylate-co-lithium methacrylate-co-methacrylic acid], poly[4-di-p-tolylaminostyrene-co-lauryl methacrylate-co-acrylic acid], poly[4,4'-bis(N-ethyl-N-ethyleneamino)-2,2'-dimethyltriphenylmethane ditolylaminobenzylmalonate], poly[4,4'-bis(N-ethyl-N-ethyleneamino)-2,2'-dimethyl-4''-methoxytriphenylmethane carbonate], poly[4-di-p-tolylaminostyrene-co-p-methylstyrene-co-lauryl methacrylate-co-acrylic acid], poly[4,4'-bis(N-ethyl-N-ethyleneamino)-2,2'-dimethyltriphenylmethane terephthalate], poly[4,4'-bis(N-ethyl-N-ethyleneamino)-2,2'-dimethyltriphenylmethane-1,4-cyclohexanedicarboxylate], poly-[bis(4-N,N-diethylamino-2-methylphenyl)methyl-p-phenoxyethyl methacrylate], poly[1,1-bis(4-[N-ethyl-N-ethyleneamino]-2-methylphenyl)isobutylidene terephthalate], poly-[4-di-p-tolylaminostyrene-co-lauryl methacrylate-co-lithium acrylate], and poly[4-di-p-tolylaminostyrene-co-lauryl methacrylate-co-acrylic acid-co-lithium acrylate].

16. A process as in claims 11, 12, 13, 14 or 15, wherein said colorant is electrically photosensitive.

17. A process as in claims 11, 12, 13, 14 or 15, wherein said colorant is an electrically photosensitive material selected from the group consisting of (a) aromatic vinyl compounds having a condensed heterocyclic nitrogen-containing nucleus;
(b) aromatic vinyl arylamine compounds;
(c) aromatic vinyl compounds having a heterocyclic nucleus;
(d) merocyanine and benzylidenes having at least one nucleus selected from the group consisting of pyran, thiopyran, selenopyran, 1,4-dihydropyridine, isoxazolone, malononitrile, cyanomethylene, barbituric acid, thiobarbituric acid, quinolinediones and isoquinolinediones;
(e) allopolar compounds;
(f) cyclobutenylium compounds; and
(g) aryl-substituted vinyl compounds.

18. A process as in claims 11, 12, 13, 14 or 15, wherein said colorant is an electrically photosensitive material selected from the group consisting of a mixed quinacridone, epindolidione and copper phthalocyanine.

19. A process as in claims 11, 12, 13, 14 or 15, wherein said colorant is an electrically photosensitive material selected from the group consisting of pyrylium, thiopyrylium, acridinium, pyridinium, rhodamine, merocyanine and cyanine dyes.

20. A dispersion as in claims 1, 2, 3, 4 or 5 wherein said electrical insulating carrier is a liquid.

21. A process as in claims 11, 12, 13, 14 or 15, wherein said electrical insulating carrier is a liquid.

* * * * *

UNITED STATES PATENT AND TRADEMARK OFFICE

CERTIFICATE OF CORRECTION

PATENT NO. : 4,322,487

DATED : March 30, 1982

INVENTOR(S) : Merrill et al

It is certified that error appears in the above-identified patent and that said Letters Patent are hereby corrected as shown below:

Column 21, line 30, the formula reading:

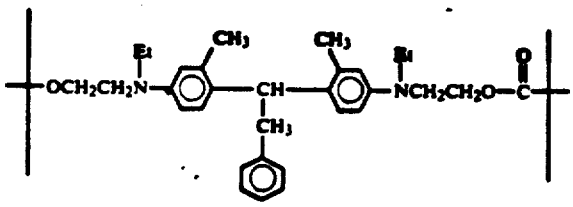

should read:

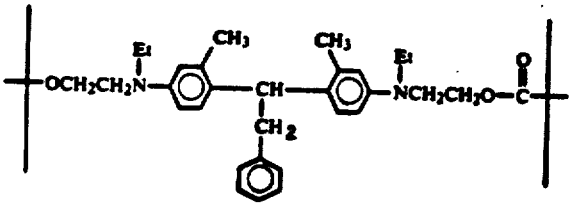

Column 27, approximate columnar line 10, the formula reading:

UNITED STATES PATENT AND TRADEMARK OFFICE

CERTIFICATE OF CORRECTION

PATENT NO. 4,322,487

DATED March 30, 1982

INVENTOR(S) Merrill et al

It is certified that error appears in the above-identified patent and that said Letters Patent are hereby corrected as shown below:

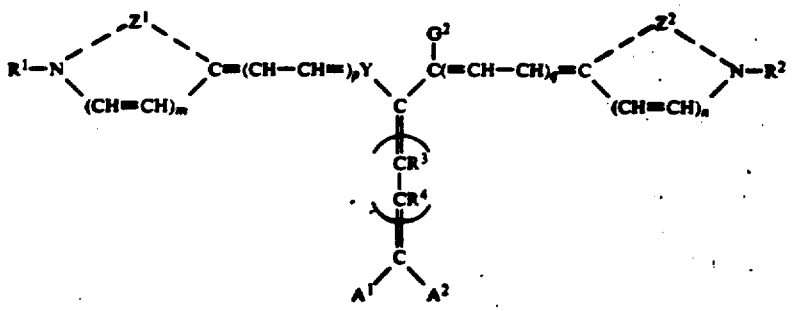

XIV.

should read:

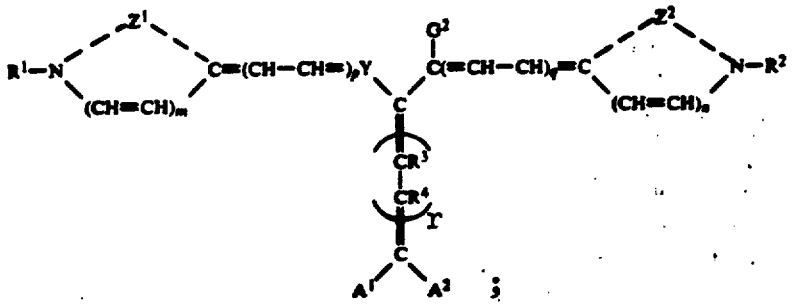

XIV.

UNITED STATES PATENT AND TRADEMARK OFFICE

CERTIFICATE OF CORRECTION

PATENT NO. : 4,322,487

DATED : March 30, 1982

INVENTOR(S) : Merrill et al

It is certified that error appears in the above-identified patent and that said Letters Patent are hereby corrected as shown below:

line 17, "represent" should read --represents. Column 35, line 15, the formula reading:

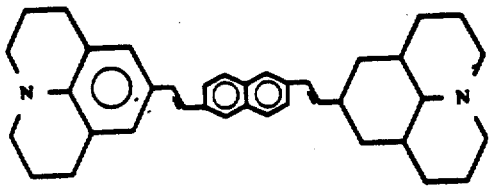

should read:

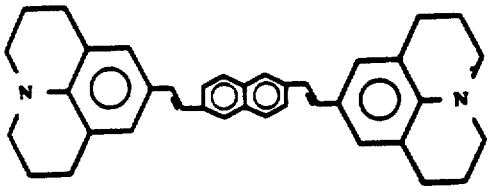

Column 42, line 21, "softened of" should read --softened or--.

UNITED STATES PATENT AND TRADEMARK OFFICE

CERTIFICATE OF CORRECTION

PATENT NO. : 4,322,487

DATED : March 30, 1982

INVENTOR(S) : Merrill et al

It is certified that error appears in the above-identified patent and that said Letters Patent are hereby corrected as shown below:

Column 43, line 7, "copolymer" should read --copolymers--. Column 44, line 9, "of both" should read --or both. Column 45, line 46, before "resin)", --a dielectric paper overcoated with a poly(vinylbutyral-- should be inserted; "Butvar-B-76" should read --Butvar B-76--. Column 51, line 28, "p-aminotetraarylmethane;s" should read --p-aminotetraarylmethanes;--.

Signed and Sealed this

*Fifteenth* Day of *February 1983*

[SEAL]

*Attest:*

GERALD J. MOSSINGHOFF

*Attesting Officer*

*Commissioner of Patents and Trademarks*